US006097921A

United States Patent [19]

Kageyama

[11] Patent Number: 6,097,921

[45] Date of Patent: Aug. 1, 2000

[54] DOUBLE-SIDED IMAGE FORMATION SYSTEM

[75] Inventor: Toshikazu Kageyama, Ebina, Japan

[73] Assignee: Fuji Xerox Co., Ltd., Tokyo, Japan

[21] Appl. No.: 09/105,041

[22] Filed: Jun. 26, 1998

[30] Foreign Application Priority Data

Jul. 1, 1997 [JP] Japan ..... 9-190437

[51] Int. Cl.[7] ..... G03G 15/22

[52] U.S. Cl. ..... 399/306; 399/309

[58] Field of Search ..... 399/9, 38, 39, 399/49, 298, 299, 302, 303, 306, 308, 309, 312, 364, 401

[56] References Cited

U.S. PATENT DOCUMENTS

| | | | |
|---|---|---|---|
| 4,958,187 | 9/1990 | Tsuchiya et al. | 399/306 |
| 5,138,389 | 8/1992 | Randall | 399/302 |
| 5,648,843 | 7/1997 | Eguchi | 399/364 |
| 5,740,510 | 4/1998 | Van den Bogaert et al. | 399/298 |
| 5,761,573 | 6/1998 | Haneda et al. | 399/309 X |
| 5,765,074 | 6/1998 | Yasui et al. | 399/49 X |
| 5,797,077 | 8/1998 | Samizo et al. | 399/309 |
| 5,805,967 | 9/1998 | DeBock et al. | 399/302 X |
| 5,842,080 | 11/1998 | Ashibe et al. | 399/49 |

FOREIGN PATENT DOCUMENTS

| | | |
|---|---|---|
| 63-63057 | 3/1988 | Japan . |
| 1-209470 | 8/1989 | Japan . |
| 2-259670 | 10/1990 | Japan . |
| 8-44122 | 2/1996 | Japan . |
| 9-274356 | 10/1997 | Japan . |

*Primary Examiner*—Sandra Brase
*Attorney, Agent, or Firm*—Oliff & Berridge, PLC

[57] ABSTRACT

A double-sided image formation system comprises two image formation sections wherein images are supported and transported on image support transporters, for transferring the images on the image support transporters to both sides of a recording medium and forming the images thereon, density sensing means (color sensing means), when sensing the image density (color) in one image formation section, for sensing the density (color) of the image transferred from one image formation section to the image support transporter in the other image formation section, and density adjustment means (color adjustment means) for matching the image density (color) in one image formation section with that in the other.

20 Claims, 24 Drawing Sheets

DOUBLE-SIDED IMAGE FORMATION SYSTEM

BACKGROUND OF THE INVENTION

This invention relates to an image formation system such as an electrophotographic copier or a printer and in particular to an improvement in a double-sided image formation system that can form an image on both sides.

Already known as a conventional double-sided image formation system is, for example, a system wherein two photosensitive bodies are placed facing each other and a first toner image (first image) is formed on one photosensitive body and a second toner image (second image) is formed on the other, then the first and second toner images on the photosensitive bodies are transferred to both sides of paper at the same time. (For example, refer to the Unexamined Japanese Patent Application Nos. Sho 63-63057 and Hei 2-259670.)

Also known is a system which comprises one photosensitive body, such as a photosensitive drum, on which a first image and a second image are supported, an intermediate transfer belt for once holding the first image, a first transfer device being disposed in a first transfer part for transferring each image on the photosensitive body to the intermediate transfer belt or paper, and a second transfer device and a paper stripping device being disposed at the paper discharge end of the intermediate transfer belt, the second transfer device for transferring the first image on the intermediate transfer belt to paper. (For example, refer to the Unexamined Japanese Patent Application Publication No. Hei 1-209470.)

Further, the present applicant already proposes an art for primarily transferring a first image on a first photosensitive body to a first intermediate transfer belt through a primary transfer device and a second image on a second photosensitive body to a second intermediate transfer belt through the primary transfer device and transferring the images on the first and second intermediate transfer belts to both sides of paper at the same time by means of a pair of transfer rolls between which the intermediate transfer belts are sandwiched. (For example, refer to the Japanese Patent Application No. Hei 8-108449.)

However, such a double-sided image formation system forms images on both sides of paper in two image formation sections and the image formation conditions in the two image formation sections easily vary, thus a technical problem that a density difference and a color difference easily occur between images on both sides of paper is involved.

Particularly, in a form wherein images are transferred to both sides of paper at the same time, a danger that the charge amount of a developed image on the polarity inversion side may differ from that on the polarity non-inversion side is high although only one transfer electric field can be set, thus a density difference and a color difference more noticeably easily occur between images on both sides of paper.

By the way, a technique of developing a density sensing patch on a photosensitive body, applying light to the patch, and reading its reflected light or diffused light by a sensor for keeping track of the development amount is known as a density sensing technique in a general electrophotographic image formation system. A known image formation system using an intermediate transfer body reads a patch density after primary transfer on the intermediate transfer body by a sensor and a patch density after secondary transfer to a secondary transfer roll by a sensor (the Unexamined Japanese Patent Application Publication No. Hei 8-44122).

However, the density sensing sensors in such related arts are provided only for keeping track of the image density in one image formation section; they are not designed for use with two image formation sections and are not indented for use so as to eliminate the density difference between two image formation sections.

Therefore, the density sensing techniques in the related arts cannot be used directly as sensors for keeping track of the density and color information of images on both sides of paper to eliminate the image quality difference (density difference and color difference) between the images on both sides of paper in a double-sided image formation system.

As disclosed in the Unexamined Japanese Patent Application Publication No. Hei 8-44122, the system sensing a patch density after secondary transfer onto a secondary transfer roll by a sensor may enable an image density closer to an actual image on paper to be sensed with high accuracy.

However, the secondary transfer roll, which is not originally an image support member, is poor in surface property as compared with an image support member such as a photosensitive body or an intermediate transfer belt; there is apprehension that if a patch image is prepared on the secondary transfer roll surface, it becomes easily hard to sense the patch density with good accuracy and there is also apprehension that when a patch image is prepared on the secondary transfer roll surface, a cleaner dedicated to removing of the patch image must always be provided and the system configuration becomes complicated accordingly.

To prepare patch images on the secondary transfer roll, the patch image size and the number of patch images prepared cannot exceed the outer periphery of the secondary transfer roll at a time and moreover patch images of reasonable size are required from the viewpoint of facilitating density sensing, thus the flexibility of preparing patch images is restricted naturally.

Particularly, when density adjustment is made for four colors in a color image formation system, a patch image must be prepared for each color on a secondary transfer roll.

At this time, to prepare patch images continuously, sequential cleaning of the secondary transfer roll after batch image formation becomes required; a normal secondary transfer roll, which is formed of a foamed substance, etc., is hard to clean and it takes time until cleaning ends. A technical problem occurs that the density adjustment time of each color in the color image formation system increases unnecessarily.

Moreover, to prepare patch images continuously, a secondary transfer roll needs to be of size for preparing 4-color patch images, but a normal secondary transfer roll is about Φ12 mm, for example, and the size is insufficient to prepare 4-color patch images.

SUMMARY OF THE INVENTION

It is therefore an object of the invention to provide a double-sided image formation system having a simple configuration that can accurately keep track of the image state on a recording medium and can record images on both sides of a recording medium with no quality difference (density difference or color difference) between images on both sides.

That is, a double-sided image formation system according to the invention comprises two image formation sections A and B wherein images T1 and T2 are supported and transported on image support transporters 1 and 2, for transferring the images T1 and T2 on the image support transporters 1 and 2 to both sides of a recording medium 3 and forming the images thereon, characterized by density sensing means 4, when sensing the image density in one image formation section A or B, for sensing the density of the image T1 or T2 transferred from one image formation section A or B to the image support transporter 2 or 1 in the other image formation section B or A, as shown in FIG. 1A.

Another form of a double-sided image formation system according to the invention comprises two image formation sections A and B for forming images T1 and T2 on both sides of a recording medium 3, characterized by density adjustment means 5 for matching the image density in one image formation section A or B with that in the other B or A, as shown in FIG. 1B.

In FIG. 1B, in the two image formation sections A and B, the images T1 and T2 are supported and transported on the image support transporters 1 and 2 and the images T1 and T2 on the image support transporters 1 and 2 are transferred to both sides of the recording medium 3 for forming images thereon. A type wherein images are formed directly on both sides of a recording medium 3 without using the image support transporters 1, 2 like an ink jet system is also included.

In such technical means, a pair of image support transporters 1 and 2 for supporting and transporting images T1 and T2 may be placed facing each other in the two image formation sections A and B or one of the two image formation sections A and B may have image support transporter 1 and the other may share the image support transporter 1 with the one image formation section and have image support transporter 2 placed facing the image support transporter 1.

Appropriate means may be selected as the image support transporter 1, 2 if it supports and transports the image T1, T2.

For example, the image support transporter may comprise only an image formation support such as a photosensitive body on which each image T1, T2 is formed and supported, or may comprise the image formation support and an intermediate transfer body being placed facing the image formation support, the intermediate transfer body to which each image T1, T2 on the image formation support is temporarily transferred, or one image support transporter may comprise only the image formation support and the other may comprise the image formation support and the intermediate transfer body.

From the viewpoint of efficiently suppressing the quality difference between images on both sides, preferably each of the formation parts of the first image T1 and the second image T2 comprises only the image formation support or the image formation support and the intermediate transfer body.

From the viewpoint of providing flexibility of a layout, preferably each comprises the image formation support and the intermediate transfer body and both intermediate transfer bodies are like belts; one intermediate transfer body may be like a belt and the other may be like a drum and both intermediate transfer bodies are like drums if they have radial elasticity to some extent.

Further, in a type wherein, for example, the first image T1 and the second image T2 are formed by an electrophotographic system as a form for transferring images to both sides of a recording medium 3 at the same time, the first and second images T1 and T2 supported on the image support transporters 1 and 2 need to be opposite in polarity to each other in the secondary transfer area.

At this time, originally, opposite polarity material may be used for the first and second images T1 and T2 or identical polarity material may be used and polarity inversion means may be placed at a proper point for inverting the polarity of one image.

In the invention in FIG. 1A, the density information provided by the density sensing means 4 can be used not only in the double-sided image formation mode, but also in a single-sided image formation mode, of course.

The density sensing means 4 may be installed as functionally independent means; however, from the viewpoint of decreasing costs, preferably sensing means for sensing different information is also used as the density sensing means 4.

A layout example of the density sensing means 4 (specifically, 4*a* and 4*b*) is shown by taking a double-sided image formation system shown in FIG. 2 as an example.

In the figure, the double-sided image formation system is of the type wherein a pair of image support transporters 1 and 1 for supporting and transporting images T1 and T2 is placed facing each other in the two image formation sections A and B and wherein each image support transporter 1, 2 in the image formation sections A and B comprises an image formation support 1*a*, 2*a* for forming and supporting each image T1, T2 and an intermediate transfer body 1*b*, 2*b* being placed facing the image formation support 1*a*, 2*a*, the intermediate transfer body 1*b*, 2*b* to which each image T1, T2 on the image formation support 1*a*, 2*a* is temporarily transferred. The double-sided image formation system of the type comprises density sensing means 4*a*, 4*b* for secondary transfer for sensing the density of an image T1, T2 transferred from the intermediate transfer body 1*b* or 2*b* in one image formation section A or B to the intermediate transfer body 2*b* or 1*b* in the other. In FIG. 2, numeral 11 denotes primary transfer means in each image formation section A, B and numeral 12 denotes secondary transfer means.

The density of the secondarily transferred image T1, T2 is sensed by such density sensing means 4*a*, 4*b* and thus can be controlled by appropriately adjusting parameters of each image formation section A, B. However, from the viewpoint of more finely controlling the density of the secondarily transferred image, preferably density sensing means 6*a*, 6*b* for primary transfer for sensing the density of a primarily transferred image on the intermediate transfer body 1*b*, 2*b* is also used.

Further, in the form using the density sensing means 6*a* and 6*b* for primary transfer and the density sensing means 4*a* and 4*b* for secondary transfer, the density sensing means 4*a*, 4*b* needs to be installed downstream from the secondary transfer position of each image formation section A, B and the density sensing means 6*a*, 6*b* needs to be installed downstream from the primary transfer position of each image formation section A, B.

Particularly, to easily and accurately sense the density of the primarily transferred image, it is advisable to install the density sensing means 6*a*, 6*b* upstream from the secondary transfer position.

However, the form wherein the density sensing means 6*a*, 6*b* is installed downstream from the secondary transfer position does not interfere with sensing of the density of the primarily transferred image if steps are taken so as not to disturb the primarily transferred image at the secondary transfer position.

In the form in FIG. 2, from the viewpoint of simplifying the system configuration, the density sensing means 6*a* and 6*b* may be removed and the density sensing means 4*a* and 4*b* for secondary transfer may also sense the densities of the primarily transferred images on the intermediate transfer bodies 1*b* and 2*b* respectively.

In the invention in FIG. 1B, the density adjustment means 5 includes all means for matching the image density in one image formation section A or B with that in the other, and the density sensing means in FIG. 1A is preferred as means for inputting density information when the density is controlled, but any other form may be used, of course.

Further, a specific algorithm may be selected appropriately for the density adjustment means 5 such that it matches the image T1, T2 density on one side with that on the other side based on the same reference or that it sends the sensing result of the image T1, T2 density in one image formation section to the other for matching the image T1, T2 density on one side with that on the other side.

The invention shown in FIGS. 1 and 2 provides double-sided image formation systems using density information. For example, to handle color images formed on both side of a recording medium, a double-sided image formation system using color information instead of density information can be constructed.

Such a double-sided image formation system according to the invention comprises two image formation sections A and B wherein color images T1 and T2 are supported and transported on image support transporters 1 and 2, for transferring the images T1 and T2 on the image support transporters 1 and 2 to both sides of a recording medium 3 and forming the images thereon, characterized by color sensing means 7, when sensing image color in one image formation section A or B, for sensing color of the image T1 or T2 transferred from one image formation section A or B to the image support transporter 2 or 1 in the other image formation section B or A, as shown in FIG. 3A.

Another form of a double-sided image formation system according to the invention comprises two image formation sections A and B for forming color images T1 and T2 on both sides of a recording medium 3, characterized by color adjustment means 8 for matching the image color in one image formation section A or B with that in the other B or A, as shown in FIG. 3B.

In FIG. 3B, in the two image formation sections A and B, the images T1 and T2 are supported and transported on the image support transporters 1 and 2 and the images T1 and T2 on the image support transporters 1 and 2 are transferred to both sides of the recording medium 3 for forming images thereon. A type wherein images are formed directly on both sides of a recording medium 3 without using the image support transporters 1, 2 like an ink jet system is also included.

In such technical means, the two image formation sections A and B and the image support transporters 1 and 2 may be selected appropriately as previously described with reference to FIGS. 1A and 1B.

The "color" in FIGS. 3A and 3B normally is determined by hue, lightness, and saturation and can be represented objectively as a numeric value by using a color specification unit system of L*a*b*, etc., for example.

Here, for sensing and matching color, the color itself may be directly sensed and matched, of course. For example, color (for example, Y (yellow), M (magenta), C (cyan), and K (black)) patches are prepared and the densities are sensed or the sensed color densities are matched, whereby reproduced colors can also be matched.

In the invention in FIG. 3A, the color information provided by the color sensing means 7 can be used not only in the double-sided image formation mode, but also in a single-sided image formation mode, of course.

The color sensing means 7 may be installed as functionally independent means; however, from the viewpoint of decreasing costs, preferably sensing means for sensing different information is also used as the color sensing means 7.

A layout example of the color sensing means 7 (specifically, 7*a* and 7*b*) is shown by taking a double-sided image formation system shown in FIG. 4 as an example.

In the figure, the double-sided image formation system is of the type wherein a pair of image support transporters 1 and 1 for supporting and transporting color images T1 and T2 is placed facing each other in the two image formation sections A and B and wherein each image support transporter 1, 2 in the image formation sections A and B comprises an image formation support 1*a*, 2*a* for forming and supporting each image T1, T2 and an intermediate transfer body 1*b*, 2*b* being placed facing the image formation support 1*a*, 2*a*, the intermediate transfer body 1*b*, 2*b* to which each image T1, T2 on the image formation support 1*a*, 2*a* is temporarily transferred. The double-sided image formation system of the type comprises color sensing means 7*a*, 7*b* for secondary transfer for sensing the color of an image T1, T2 transferred from the intermediate transfer body 1*b* or 2*b* in one image formation section A or B to the intermediate transfer body 2*b* or 1*b* in the other. In FIG. 4, numeral 11 denotes primary transfer means in each image formation section A, B and numeral 12 denotes secondary transfer means.

The color of the secondarily transferred image T1, T2 is sensed by such color sensing means 7*a*, 7*b* and thus can be controlled by appropriately adjusting parameters of each image formation section A, B. However, from the viewpoint of more finely controlling the color of the secondarily transferred image, preferably color sensing means 9*a*, 9*b* for primary transfer for sensing the color of a primarily transferred image on the intermediate transfer body 1*b*, 2*b* is also used.

Further, in the form using the color sensing means 9*a* and 9*b* for primary transfer and the color sensing means 7*a* and 7*b* for secondary transfer, the color sensing means 7*a*, 7*b* needs to be installed downstream from the secondary transfer position of each image formation section A, B and the color sensing means 9*a*, 9*b* needs to be installed downstream from the primary transfer position of each image formation section A, B.

Particularly, to easily and accurately sense the color of the primarily transferred image, it is advisable to install the color sensing means 7*a*, 7*b* upstream from the secondary transfer position.

However, the form wherein the color sensing means 9*a*, 9*b* is installed downstream from the secondary transfer position does not interfere with sensing of the color of the primarily transferred image if steps are taken so as not to disturb the primarily transferred image at the secondary transfer position.

In the form in FIG. 4, from the viewpoint of simplifying the system configuration, the color sensing means 9*a* and 9*b* may be removed and the color sensing means 7*a* and 7*b* for secondary transfer may also sense the colors of the primarily transferred images on the intermediate transfer bodies 1*b* and 2*b* respectively.

In the invention in FIG. 3B, the color adjustment means 8 includes all means for matching the image color in one image formation section A or B with that in the other, and the color sensing means in FIG. 3A is preferred as means for inputting color information when the color is controlled, but any other form may be used, of course.

Further, a specific algorithm may be selected appropriately for the color adjustment means 8 such that it matches the image T1, T2 color on one side with that on the other side based on the same reference or that it sends the sensing result of the image T1, T2 color in one image formation section to the other for matching the image T1, T2 color on one side with that on the other side.

Next, the operation of the above-described technical means is as follows:

In the invention shown in FIG. 1A, for example, when sensing the image density in one image formation section A (or B), the density sensing means 4 senses the density of the image T1 (or T2) transferred from one image formation section A (or B) to the image support transporter 2 (or 1) in the other image formation section B (or A).

At this time, the image T1 (or T2) sensed by the density sensing means 4 corresponds to the image in a state in which it is transferred to the recording medium 3, thus the image density sensing operation is performed in a state close to the image density on the recording medium 3.

In the invention shown in FIG. 1B, the density adjustment means 5 matches the image density in one image formation section A or B with that in the other B or A.

Thus, the densities of the images T1 and T2 transferred to and formed on both sides of the recording medium 3 from the two image formation sections A and B match and therefore the density difference between the images T1 and T2 is eliminated.

Further, in the invention shown in FIG. 3A, for example, when sensing the image color in one image formation section A (or B), the color sensing means 7 senses the color of the image T1 (or T2) transferred from one image formation section A (or B) to the image support transporter 2 (or 1) in the other image formation section B (or A).

At this time, the image T1 (or T2) sensed by the color sensing means 7 corresponds to the image in a state in which it is transferred to the recording medium 3, thus the image color sensing operation is performed in a state close to the image color on the recording medium 3.

In the invention shown in FIG. 3B, the color adjustment means 8 matches the image color in one image formation section A or B with that in the other B or A.

Thus, the colors of the images T1 and T2 transferred to and formed on both sides of the recording medium 3 from the two image formation sections A and B match and therefore the color difference between the images T1 and T2 is eliminated.

DETAILED DESCRIPTION OF THE PREFERRED EMBODIMENTS

Referring now to the accompanying drawings, there are shown preferred embodiments of the invention.

(First Embodiment)

Figure 1A:
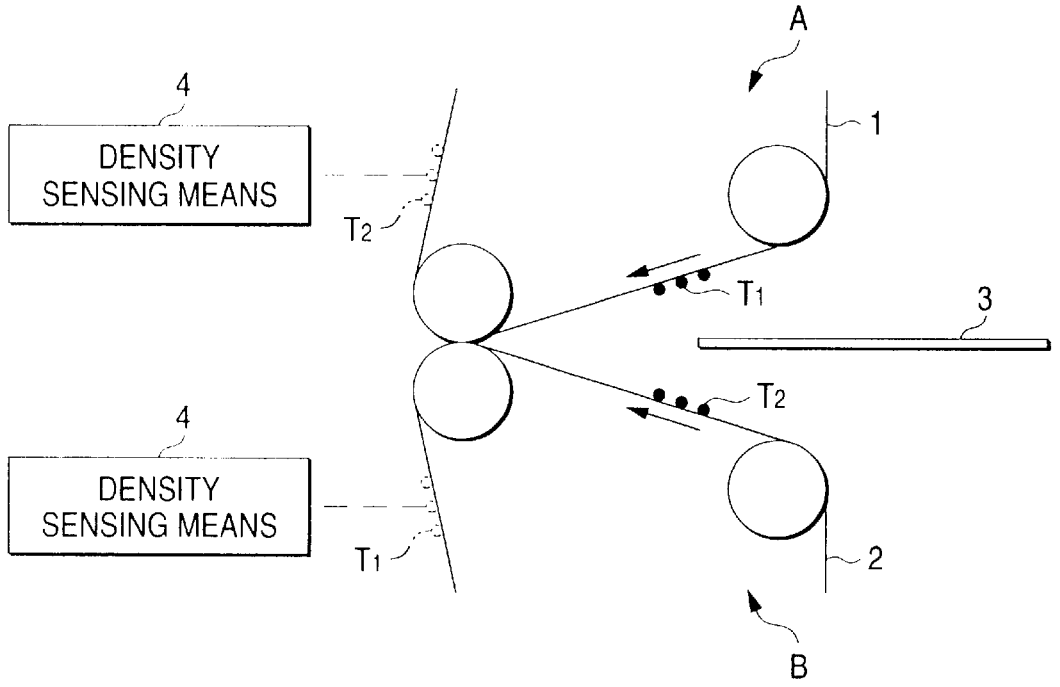
FIG. 1A is a schematic representation to show a form of a double-sided image formation system according to the invention.
Figure 1B:
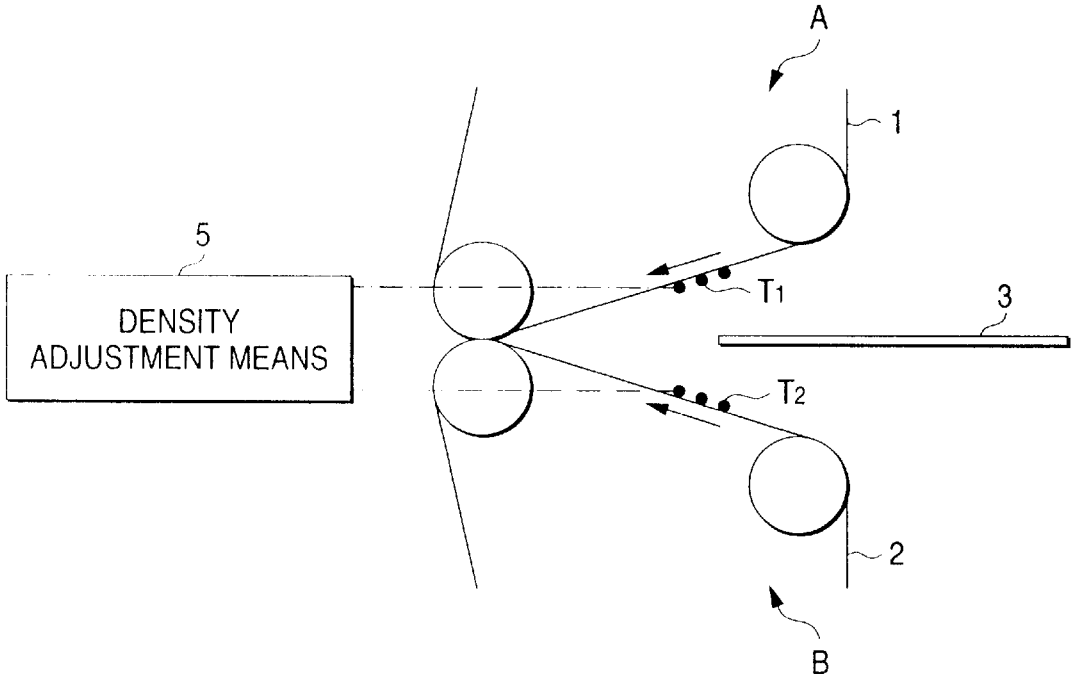
FIG. 1B is a schematic representation to show another form of a double-sided image formation system according to the invention.
Figure 2:
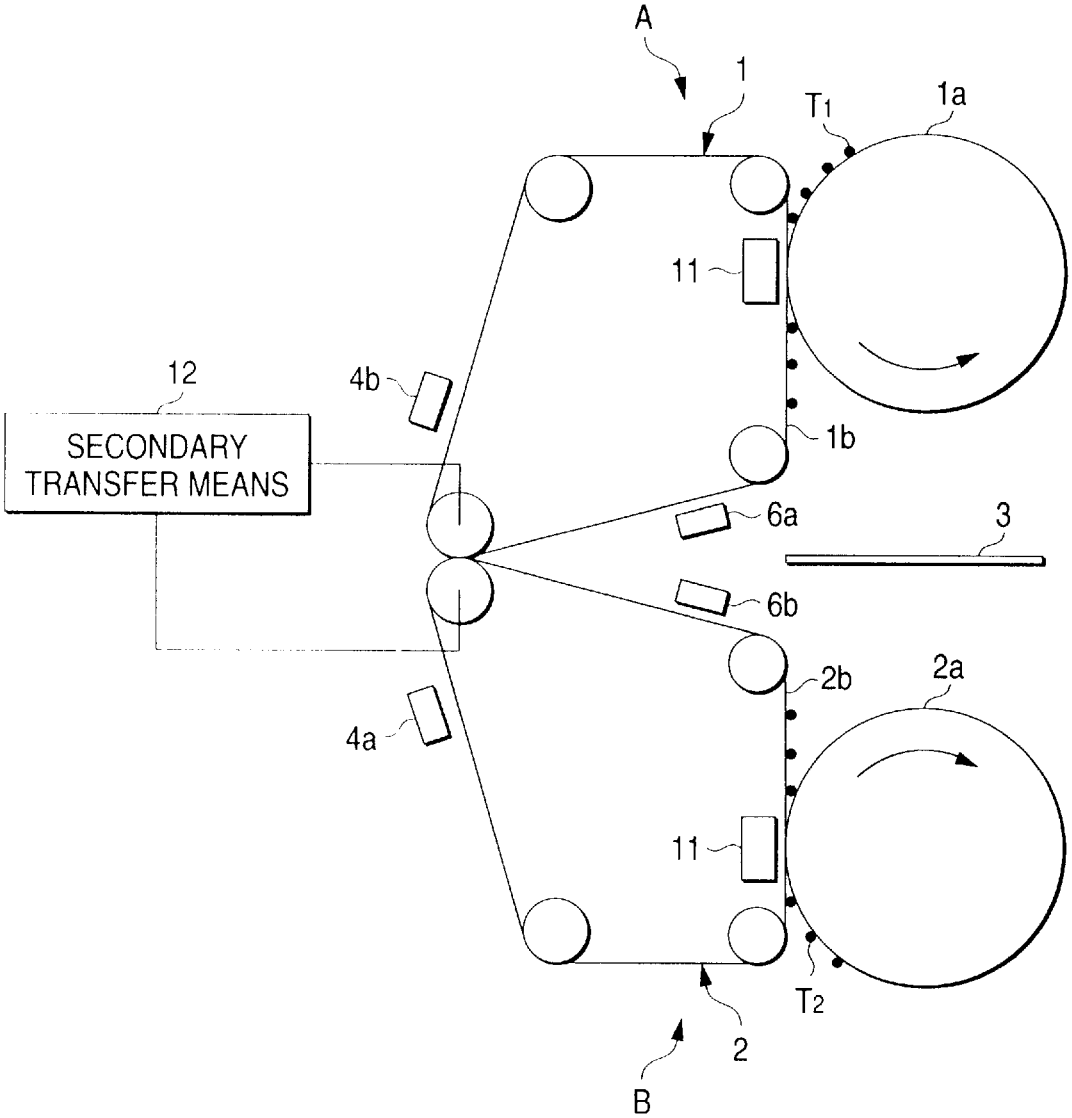
FIG. 2 is a schematic representation to show a layout example of density sensing means in a double-sided image formation system according to the invention.
Figure 3A:
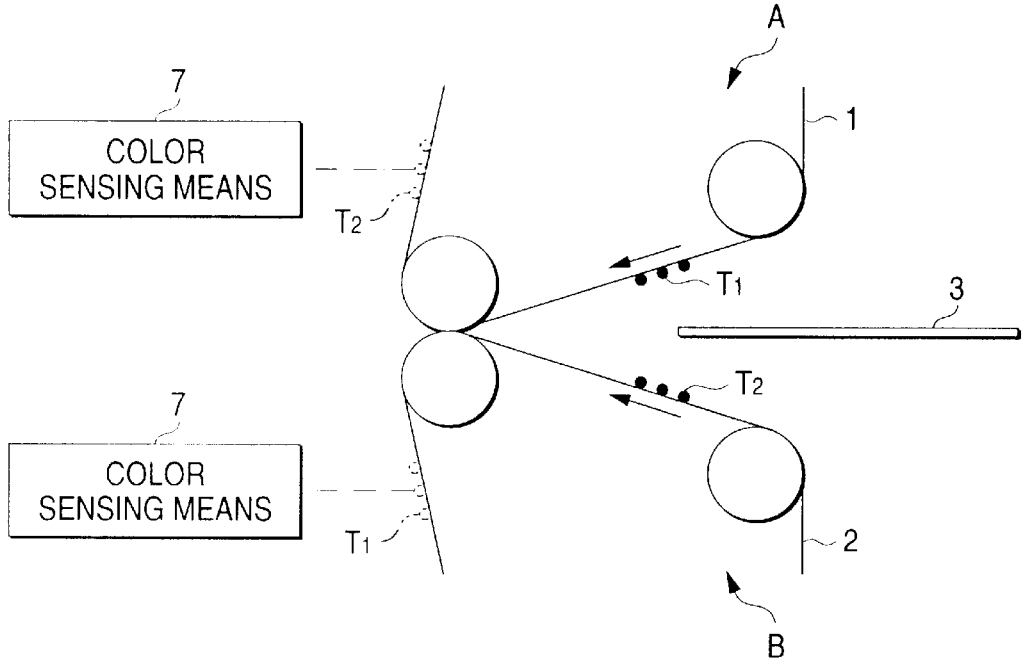
FIG. 3A is a schematic representation to show still another form of a double-sided image formation system according to the invention.
Figure 3B:
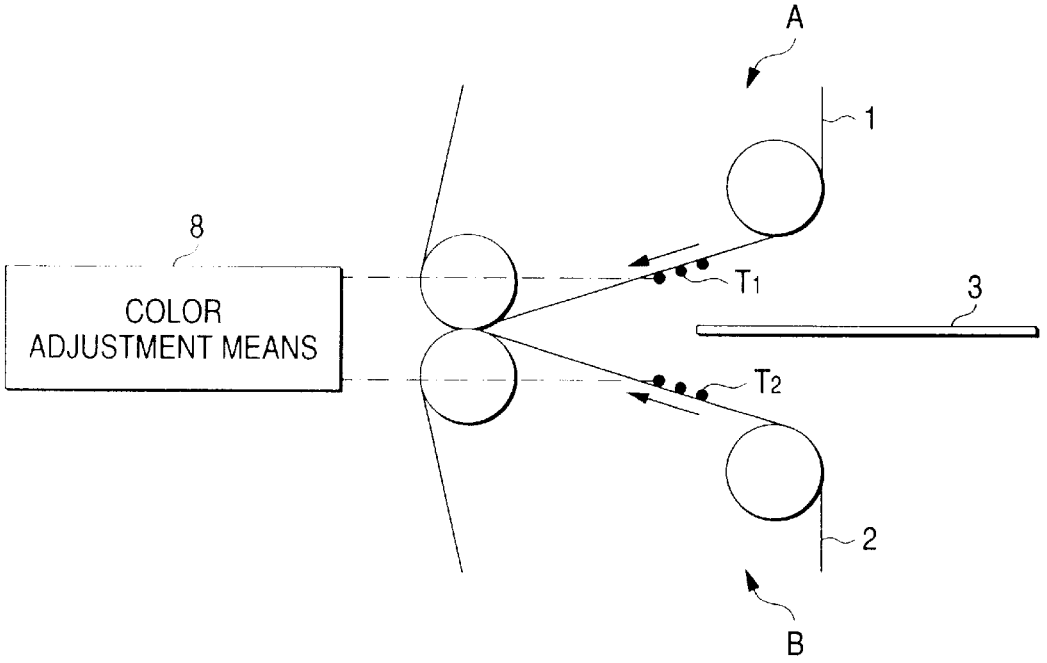
FIG. 3B is a schematic representation to show another form of a double-sided image formation system according to the invention.
Figure 4:
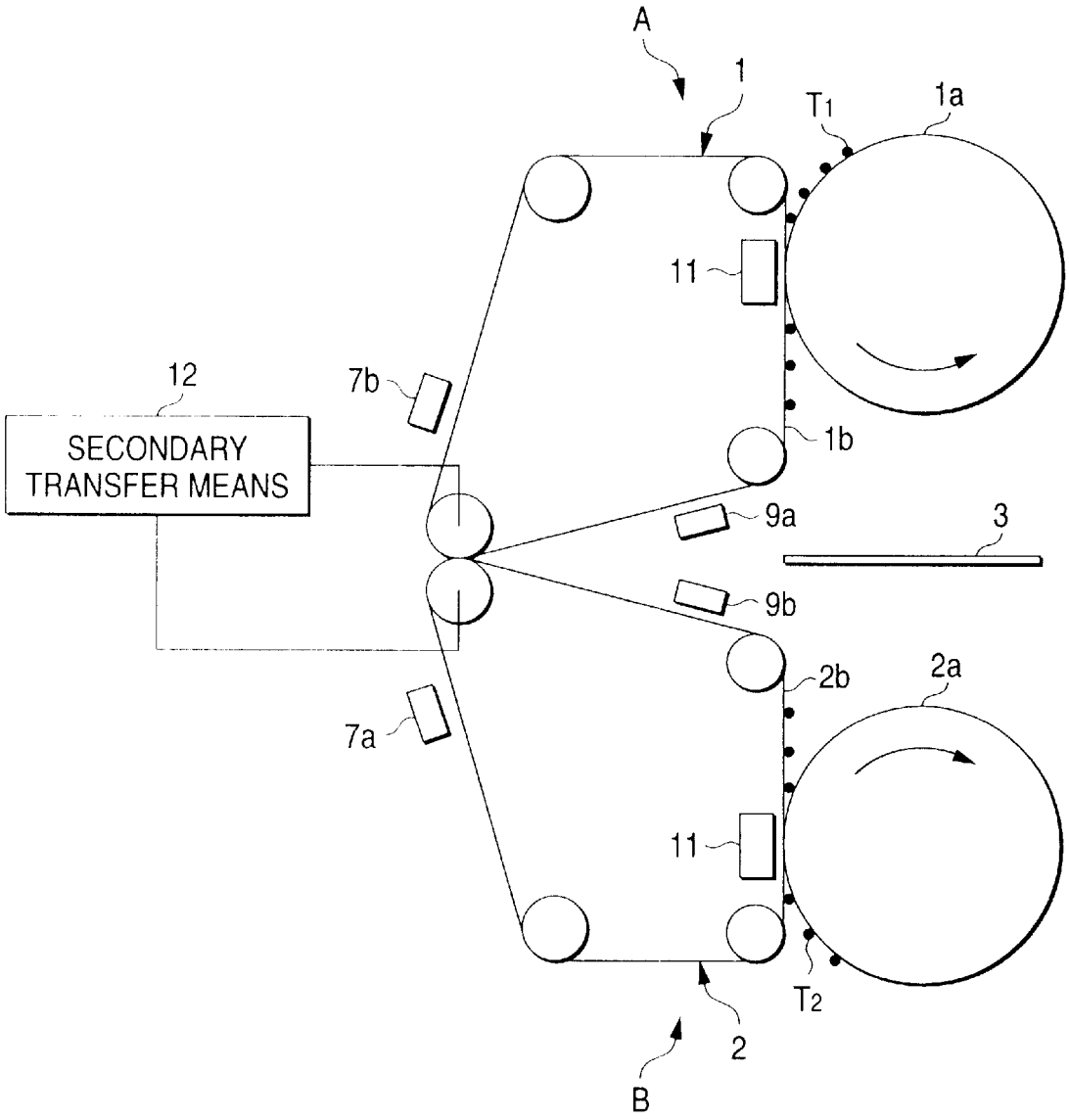
FIG. 4 is a schematic representation to show a layout example of color sensing means in a double-sided image formation system according to the invention.
Figure 5:
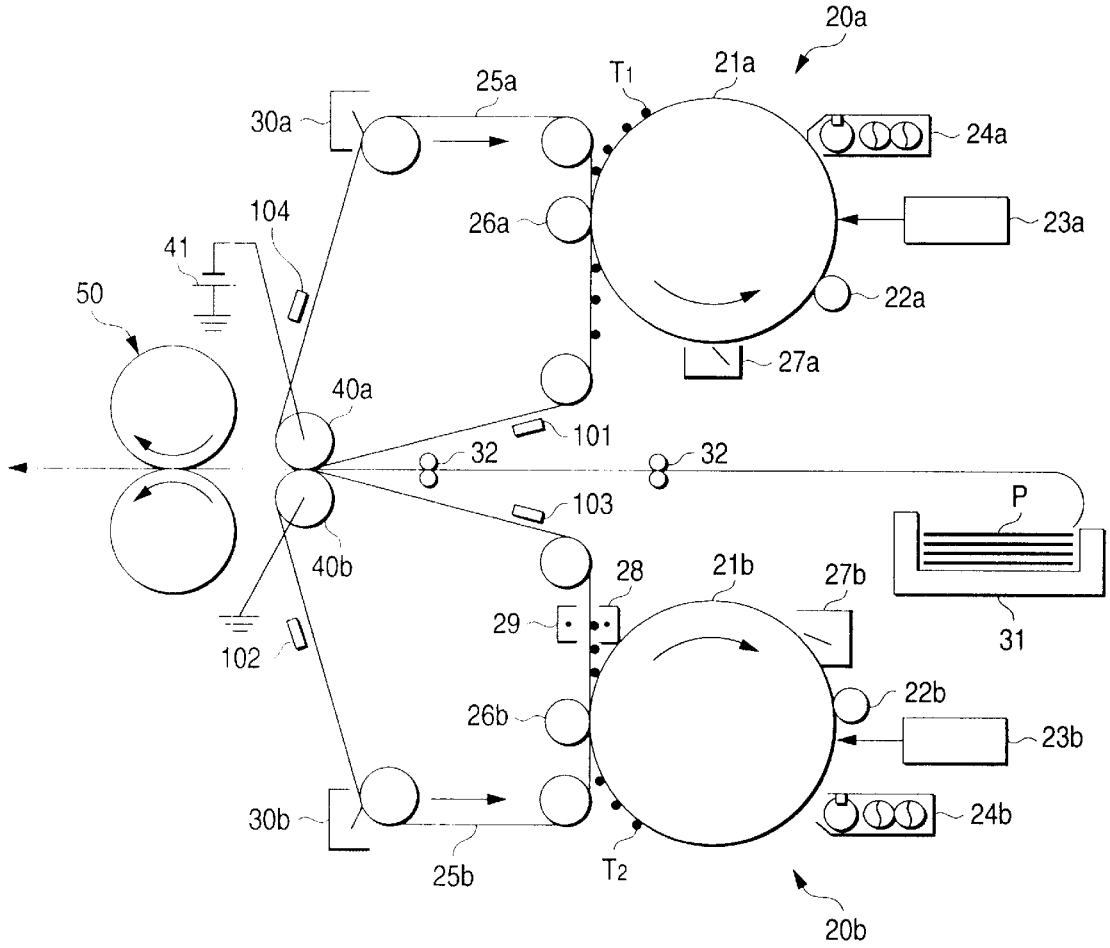
FIG. 5 is a schematic representation to show an outline of a double-sided image formation system according to a first embodiment of the invention.

FIG. 5 shows a schematic configuration of a first embodiment of a double-sided image formation system incorporating the invention.

In the figure, the double-sided image formation system comprises a first image formation section 20*a* for forming a first image on a first side of paper P, a second image formation section 20*b* for forming a second image on a second side of paper P, and a fuser 50 for fusing the images on the paper P passing through the first and second image formation sections 20*a* and 20*b*.

In the embodiment, the image formation section 20*a*, 20*b* comprises a photosensitive drum 21*a*, 21*b*, a charge roll 22*a*, 22*b* for charging the surface of the photosensitive drum 21*a*, 21*b*, an exposure device 23*a*, 23*b* for writing an electrostatic latent image for a first image, a second image onto the charged photosensitive drum 21*a*, 21*b*, a developing device 24*a*, 24*b* for visualizing the electrostatic latent image written onto the photosensitive drum 21*a*, 21*b* in toner, an intermediate transfer belt 25*a*, 25*b* placed in contact with the photosensitive drum 21*a*, 21*b*, a primary transfer roll 26*a*, 26*b* for primarily transferring a toner image T1, T2 on the photosensitive drum 21*a*, 21*b* (for example, a positive image in the embodiment) onto the intermediate transfer belt 25*a*, 25*b*, and a cleaner 27*a*, 27*b* for removing the remaining toner on the photosensitive drum 21*a*, 21*b*.

A pair of inversion corotrons 28 and 29 is placed facing each other with the intermediate transfer belt 25*b* between downstream from the primary transfer position of the intermediate transfer belt 25*b* in the second image formation section 20*b*.

In the embodiment, the intermediate transfer belt 25*a*, 25*b* is placed on a proper number of holding rolls (one is a drive roll and others are driven rolls) and is turned in synchronization with the photosensitive drum 21*a*, 21*b*. Numerals 30*a* and 30*b* are belt cleaners for removing the remaining toner on the intermediate transfer belts 25*a* and 25*b*.

The intermediate transfer belt 25*a*, 25*b* is formed so that volume resistivity becomes $10^9$–$10^{14}\Omega\cdot$cm with a proper amount of an antistatic agent of carbon black, etc., contained in a resin such as polyimide, acrylic resin, vinyl chloride, polyester, polycarbonate, or polyethylene terephthalate (PET) or rubber, and is set 0.08 mm thick, for example.

Further, a holding roll placed corresponding to an area that the intermediate transfer belt 25*a*, 25*b* comes in contact with or approaches is formed as a secondary transfer roll 40*a*, 40*b*.

If conductive rolls are used as both the secondary transfer rolls 40*a* and 40*b*, images can be transferred. However, when an image is transferred to small-size paper, if the first, second intermediate transfer belt 25*a*, 25*b* comes in direct contact with the secondary transfer roll 40*a*, 40*b*, an excessive current flows between the intermediate transfer belt 25*a*, 25*b* and the secondary transfer roll 40*a*, 40*b* and a sufficient transfer electric field cannot be formed; a transfer failure occurs and the intermediate transfer belt 25*a*, 25*b* is easily damaged. Thus, preferably at least the bias application roll comprises a conductive roll coated with a semiconductive or insulating material.

In the embodiment, each of the secondary transfer rolls 40*a* and 40*b* comprises a metal shaft coated with carbon black dispersed in EPDM rubber with volume resistivity set to $10^6\Omega\cdot$cm. A transfer bias 41 is applied to the shaft of the secondary transfer roll 40*a* and the shaft of the secondary transfer roll 40*b* is grounded.

In addition, a coat material comprising conductive particles (carbon black, aluminum, etc.,) or an ion conducting agent (LiClO4, etc.,) dispersed in polyurethane rubber or silicone rubber or the like can be used; preferably, volume resistivity is set to $10^5$–$10^9\Omega\cdot$cm.

Further, in the embodiment, negative-charged toner is used as the toners T1 and T2, direct current +10 $\mu$A is applied to the primary transfer roll 26*a*, 26*b*, direct current of DC voltage +1 kV, −1 kV superimposed on AC voltage 8 kVp-p/600 Hz is applied to the inversion corotron 28, 29, and DC voltage −2 kV is applied to the secondary transfer roll 40*a*.

The outer diameters of the first and second photosensitive drums 21*a* and 21*b* are made the same and the circumferential lengths of the first and second intermediate transfer belts 25*a* and 25*b* are made the same.

The distance between the secondary transfer position and the fuser 50 is made shorter than the minimum paper length and the rotation speed of each fusing roll is made equal to or slightly slower than the speed of the intermediate transfer belt 25*a*, 25*b*.

The upper and lower fusing rolls of the fuser 50 are formed as the same shape so that fuse nip becomes linear, and each fusing roll contains a heater.

In FIG. 5, numeral 31 is a paper tray and numeral 32 is a transport roll for transporting paper P.

In the embodiment, the following density sensors are disposed: A primary transfer density sensor 101 for sensing the density of an image primarily transferred to the intermediate transfer belt 2*a*, a secondary transfer density sensor 102 for sensing the density of an image secondarily transferred from one intermediate transfer belt 25*a* to the other intermediate transfer belt 25*b* by the secondary transfer rolls 40 (40*a* and 40*b*), a primary transfer density sensor 103 for sensing the density of an image primarily transferred to the intermediate transfer belt 25*b*, and a secondary transfer density sensor 104 for sensing the density of an image secondarily transferred from one intermediate transfer belt 25*b* to the other intermediate transfer belt 25*a* by the secondary transfer rolls 40.

Particularly, in the embodiment, the density sensors 101–104 are optical sensors placed facing the image support face of the intermediate transfer belt 25*a* or 25*b*; the primary transfer density sensors 101 and 103 are placed downstream from the primary transfer position and upstream from the secondary transfer position and the secondary transfer density sensors 102 and 104 are placed downstream from the secondary transfer position.

Figure 6:
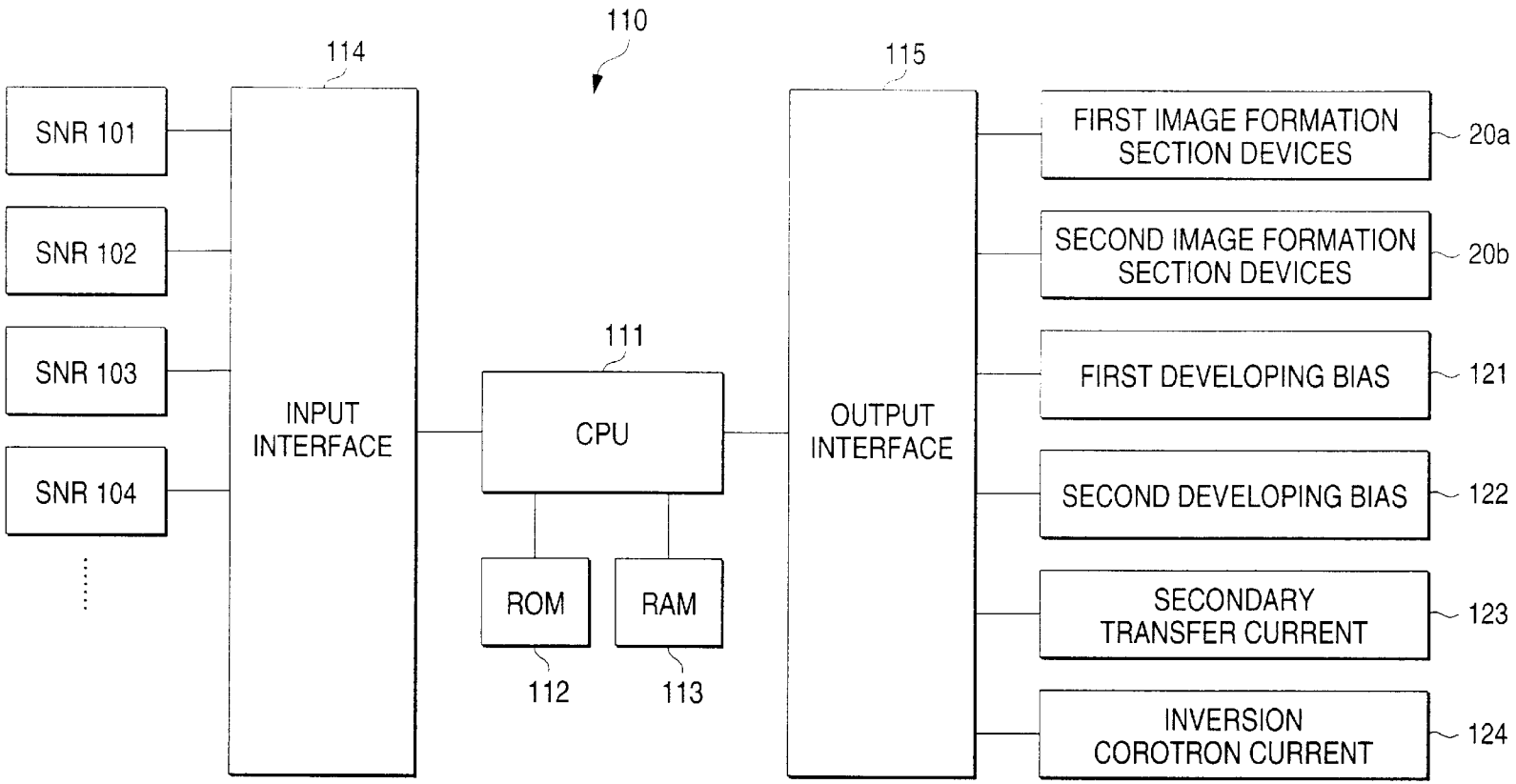
FIG. 6 is a block diagram to show a control system for executing a density adjustment mode used in the first embodiment of the invention.

FIG. 6 shows a density adjustment system for matching the density of an image on one side of paper P with that on the other side.

In the figure, a density adjustment system 110 is a microcomputer system which comprises a CPU (central processing unit) 111, ROM (read-only memory) 112, RAM (random access memory) 113, an input interface 114, and an output interface 115. For example, a density adjustment start signal (not shown) and sensing signals from the density sensors (SNRs in FIG. 6) 101–104 are input through the input interface 114 into the CPU 111, which then executes a density adjustment mode program previously built in the ROM 112 (see FIG. 7) based on the density adjustment start signal, senses the densities of patch images formed in the image formation sections 20*a* and 20*b* by the density sensors 101–104, generates control signals for adjusting parameters of the image formation sections 20*a* and 20*b* so as to match the density of the patch image on one side of paper with that on the other side based on the sensing signals, and controls a first developing bias 121, a second developing bias 122, a secondary transfer current 123, and an inversion corotron current 124, for example, through the output interface 115.

Next, the operation of the double-sided image formation system according to the embodiment is as follows:

First, an image formation process associated with the normal print mode will be discussed.

A first toner image T1 formed on the first photosensitive drum 21*a* is transferred by the primary transfer roll 26*a* onto the first intermediate transfer belt 25*a* moving roughly at the same speed as the first photosensitive drum 21*a*.

Likewise, a second toner image T2 formed on the second photosensitive drum 21*b* at the same timing as the image on the first photosensitive drum 21*a* is transferred onto the second intermediate transfer belt 25*b* by the primary transfer roll 26*b* and voltage is applied to a pair of inversion corotrons 28 and 29 placed with the second intermediate transfer belt 25*b* between, thereby inverting the polarity of the second toner image T2.

Paper P is transported from the paper tray 31 to the gap between the secondary transfer rolls 40*a* and 40*b* at the matched timing and the toner images T1 and T2 on the intermediate transfer belts 25*a* and 25*b* are transferred onto the paper P at the same time, then the toner images on both sides of the paper P are fused by the fuser 50 at the same time.

The remaining toner on the intermediate transfer belts 25*a* and 25*b* is removed by the belt cleaners 30*a* and 30*b*.

Figure 7:
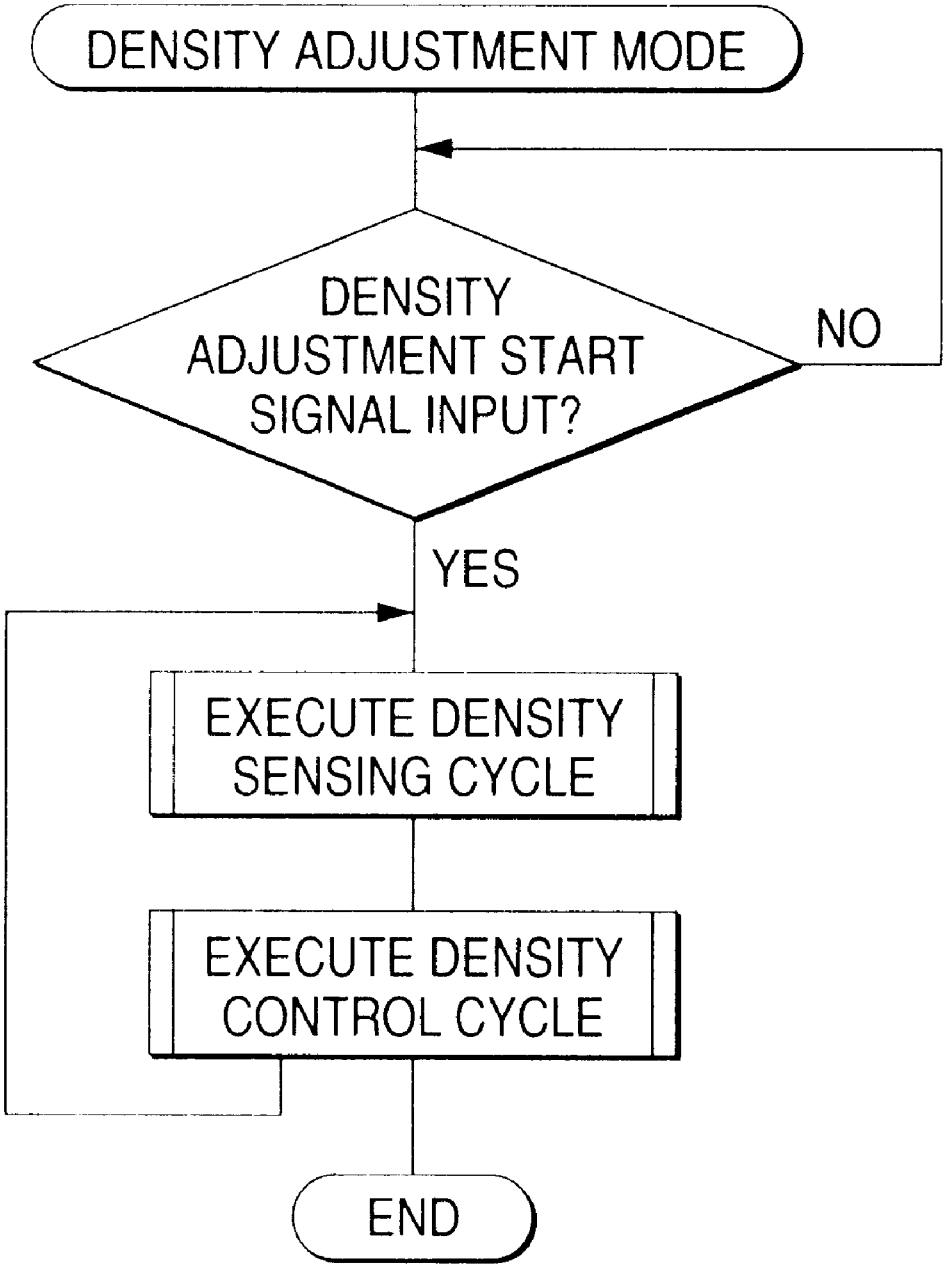
FIG. 7 is a flowchart of the density adjustment mode used in the first embodiment of the invention.

FIG. 7 shows a density adjustment mode for making the same densities of images on both sides, provided aside from the print mode as described above.

The density adjustment mode is executed each time power of the image formation system is turned on (at the print cycle start time) or is turned off (at the print cycle end time) or at an appropriate timing during the print cycle (for example, every predetermined number of print sheets). In FIG. 7, the density adjustment start signal is an image formation system power on or off signal or a signal indicating that the number of print sheets reaches the predetermined number of sheets.

Now, assuming that the density adjustment mode is started in association with the density adjustment start signal, first a density sensing cycle (see FIG. 8) is executed.

Figure 8:
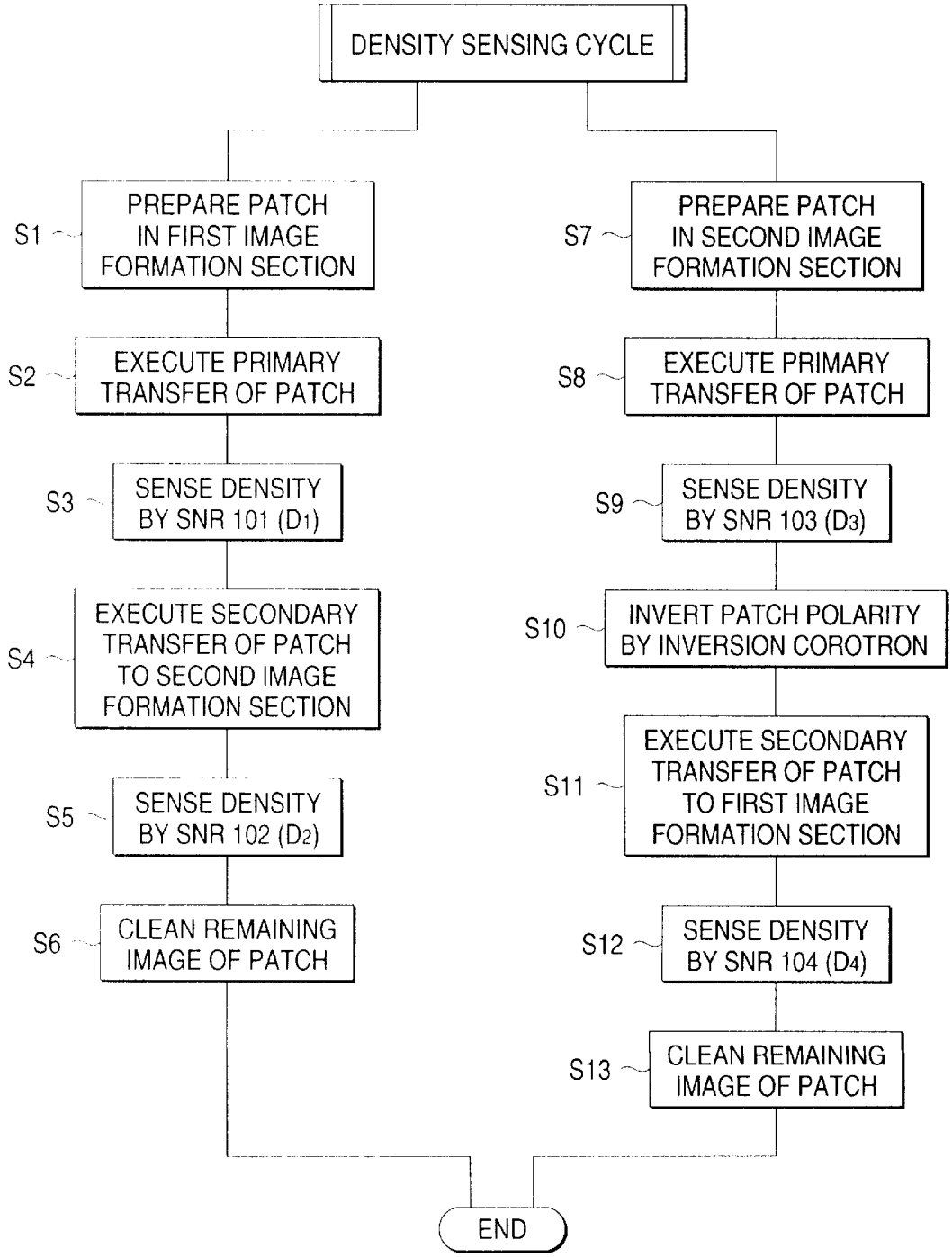
FIG. 8 is a flowchart to show a specific example of the density sensing cycle in FIG. 7.

In FIG. 8, a first toner patch T1 formed on the first photosensitive drum 21*a* is transferred by the primary transfer roll 26*a* onto the first intermediate transfer belt 25*a* moving roughly at the same speed as the first photosensitive drum 21*a*. The density of the transferred toner patch T1 is sensed by reading the reflected density therefrom by the primary transfer density sensor 101, then at the secondary transfer part where the first and second intermediate transfer belts 25*a* and 25*b* are close to each other, without transporting paper, the first toner patch T1 is transferred to the second intermediate transfer belt 25*b* and the density of the toner patch T1 transferred onto the second intermediate transfer belt 25*b* is read by the secondary transfer density sensor 102.

Here, sensing signals of the density sensors 101 and 102 are D1 and D2.

The remaining image of the toner patch T1 on the second intermediate transfer belt 25*b* is removed by the second belt cleaner 30*b*.

Likewise, a second toner patch T2 formed on the second photosensitive drum 21*b* is transferred by the primary transfer roll 26*b* onto the second intermediate transfer belt 25*b* moving roughly at the same speed as the second photosensitive drum 21*b*. Voltage is applied to a pair of inversion corotrons 28 and 29 placed with the second intermediate transfer belt 25*b* between, thereby inverting the polarity of the second toner patch T2. The density of the transferred toner patch T2 is sensed by reading the reflected density therefrom by the primary transfer density sensor 103, then at the secondary transfer part where the first and second intermediate transfer belts 25*a* and 25*b* are close to each other, without transporting paper, the toner patch T2 is transferred to the first intermediate transfer belt 25*a* and the density of the toner patch T2 transferred onto the first intermediate transfer belt 25*a* is read by the secondary transfer density sensor 104.

Here, sensing signals of by the density sensors 103 and 104 are D3 and D4.

The remaining image of the toner patch T2 on the first intermediate transfer belt 25*a* is removed by the first belt cleaner 30*a*.

Upon completion of such a density sensing cycle, then a density control cycle (see FIG. 9) is executed.

Figure 9:
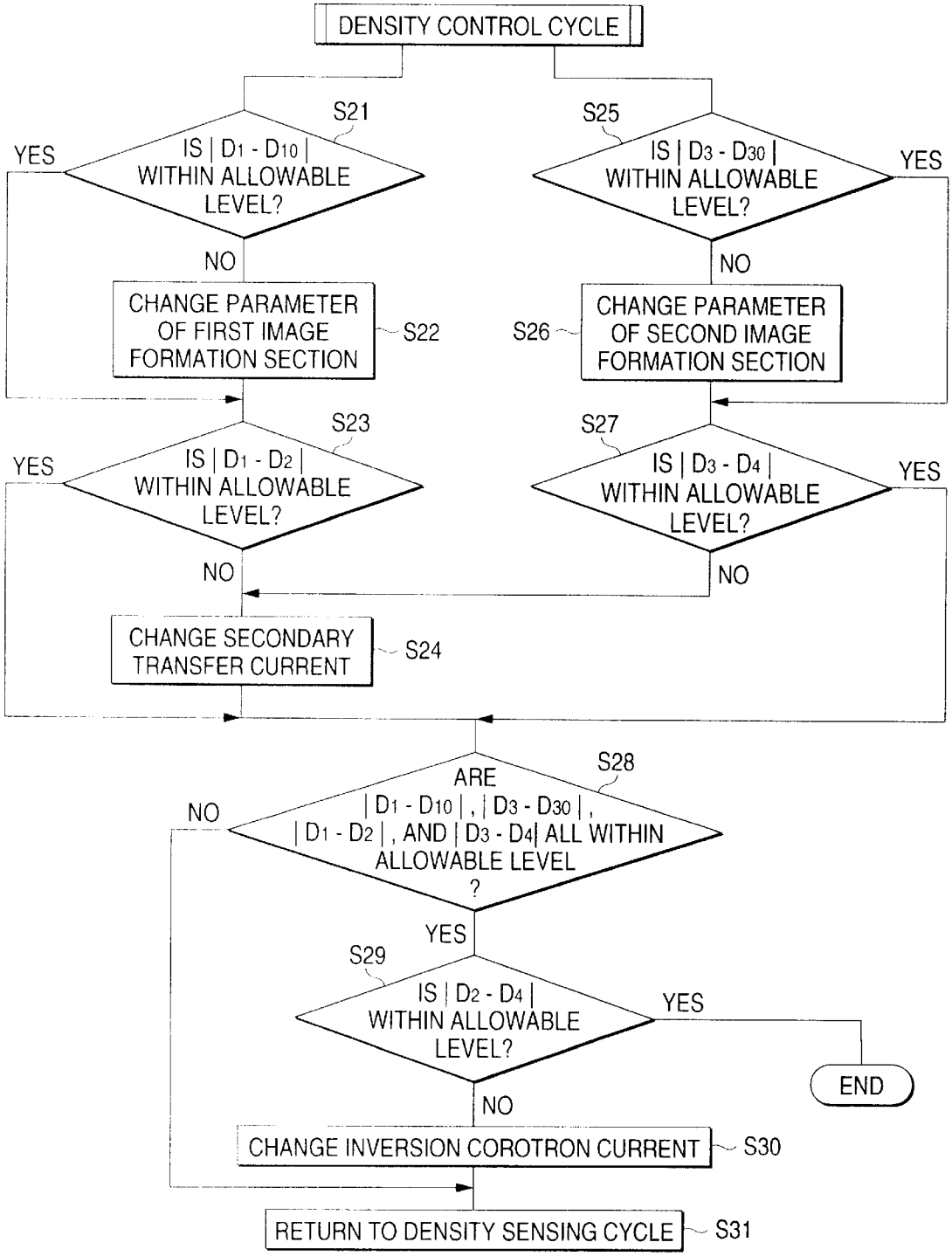
FIG. 9 is a flowchart to show a specific example of the density control cycle in FIG. 7.

In FIG. 9, the densities sensed by the primary transfer density sensors 101 and 103 (D1 and D3) are compared with the same reference values (D10 and D30 (=D10) and if the difference between D1 and D10, D3 and D30 exceeds an allowable level, the parameter of the corresponding image formation section 20*a*, 20*b* (in the embodiment, for example, developing bias of the developing device 24*a*, 24*b*) is controlled for making a correction so that the densities of the images on both sides become the same.

The parameter of the image formation section 20*a*, 20*b* to be controlled is not limited to the developing bias and one or more of parameters of the charge amount of the charge roll 22*a*, 22*b*, the light quantity of the exposure device 23*a*, 23*b*, the transfer current value of the primary transfer roll 26*a*, 26*b*, and the like may be selected appropriately.

Further, the density difference between the primarily and secondarily transferred images in the image formation section 20*a* (|D1–D2|) and that in the image formation section 20*b* (|D3–D4|) are found and if at least either of the differences exceeds an allowable level, the secondary transfer current is controlled for making a correction so that the secondary transfer condition becomes proper.

Further, whether or not the densities sensed by the secondary transfer density sensors 102 and 104 (D2 and D4) finally under the condition that |D1–D10|, |D3–D30|, |D1–D2|, and |D3–D4| are all within the allowable level are at the same level is determined. If the difference between D2 and D4 exceeds an allowable level, the voltage applied to a pair of inversion corotrons 28 and 29 placed with the second intermediate transfer belt 25*b* between (corresponding to inversion corotron current) is controlled for making a correction so that the densities of the images on both sides become the same.

In FIG. 9, if any of the first developing bias, the second developing bias, the second transfer current, or the inversion corotron current is changed, control returns again to the density sensing cycle and the density sensing cycle and the density control cycle are repeated until |D1–D10|, |D3–D30|, |D1–D2|, |D3–D4|, and |D2–D4| become all within the allowable levels (the densities of the primarily transferred images, the secondarily transferred images on both sides equal).

In the density control cycle in FIG. 9, the first developing bias and the second developing bias are changed based on the densities of the primarily transferred images, but the invention is not limited to it. For example, the densities sensed by the secondary transfer density sensors 102 and 104 (D2 and D4) are compared with the same reference values (D20 and D40 (=D20) and if the difference between D2 and D20, D4 and D40 exceeds an allowable level, the corresponding developing bias or any other parameter may be controlled.

In the embodiment, the density control cycle adopts the method of matching the densities of images on both sides with the same reference values, but the invention is not limited to it. For example, as shown in FIG. 10, after the image density in one image formation section 20*a* is matched with the reference value, the image density in the other image formation section 20*b* may be matched with the sensing result matched with the image density in one image formation section 20*a*.

Figure 10:
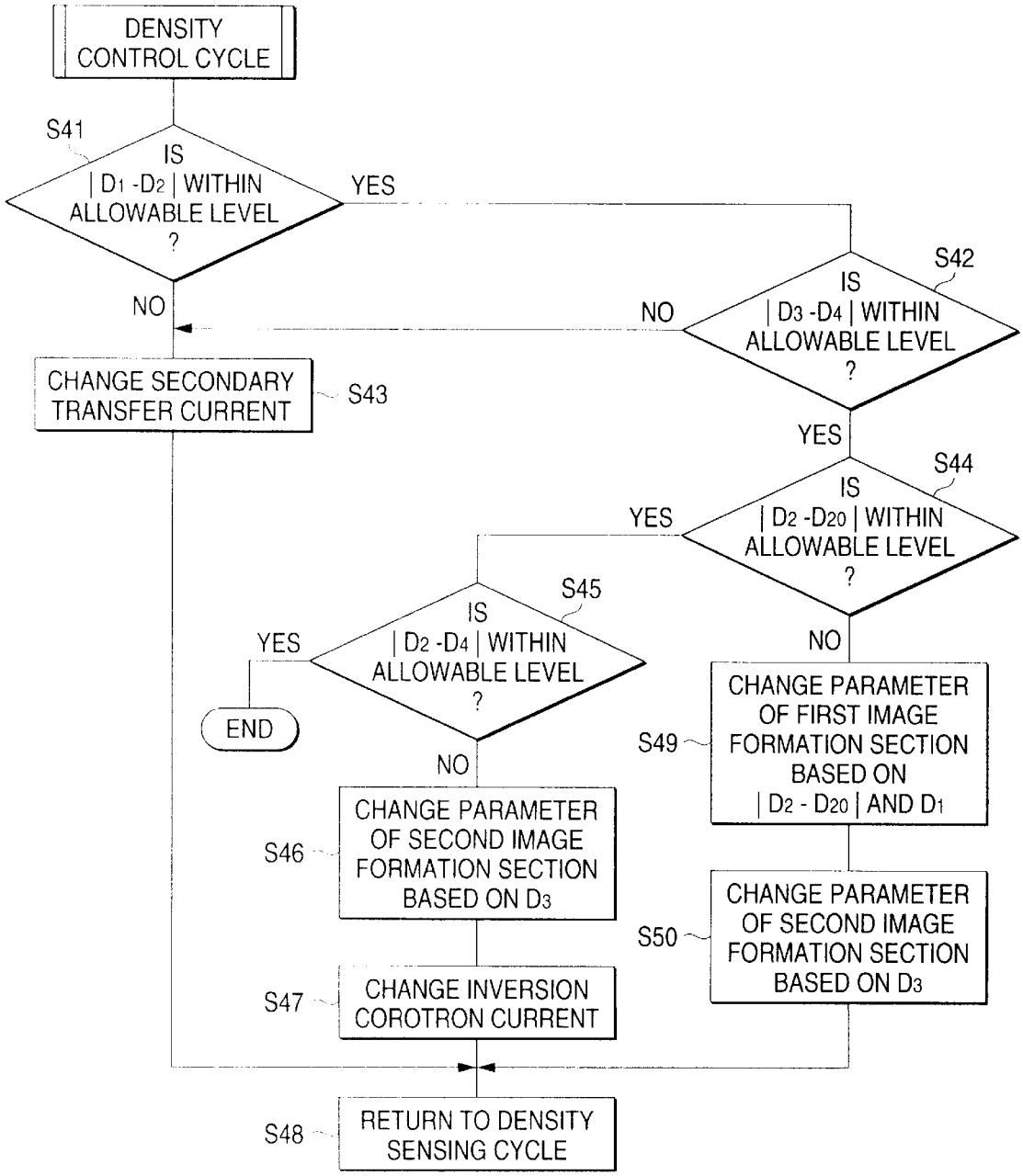
FIG. 10 is a flowchart to show another specific example of the density control cycle in FIG. 7.

That is, in the method shown in FIG. 10, first the density difference between the primarily and secondarily transferred images in the image formation section 20*a* (|D1–D2|) and that in the image formation section 20*b* (|D3–D4|) are found and if at least either of the differences exceeds an allowable level, the secondary transfer current is controlled for making a correction so that the secondary transfer condition becomes proper.

The density D2 of the secondarily transferred image in one image formation section 20*a* is compared with the reference value (D20) under the condition that |D1–D2| and |D3–D4| are within the allowable level. If the difference between the density D2 and the reference value D20 exceeds an allowable level, the parameter of the first image formation section 20*a* (first developing bias, etc.,) is changed based on the difference (|D2–D20|) and D1 and the parameter of the second image formation section 20*b* (second developing bias, etc.,) is changed based on D3.

Further, whether or not the densities sensed by the secondary transfer density sensors 102 and 104 (D2 and D4) finally under the condition that |D2–D20| is within the allowable level are at the same level is determined. If the difference between D2 and D4 exceeds an allowable level, the voltage applied to a pair of inversion corotrons 28 and 29 placed with the second intermediate transfer belt 25*b* between (corresponding to inversion corotron current) is controlled for making a correction so that the densities of the images on both sides become the same.

In FIG. 10, if any of the first developing bias, the second developing bias, the second transfer current, or the inversion corotron current is changed, control returns again to the density sensing cycle and the density sensing cycle and the density control cycle are repeated until |D1–D2|, |D3–D4|, |D2–D20|, and |D2–D4| become all within the allowable levels (the densities of the primarily transferred images, the secondarily transferred images on both sides equal).

Figure 11:
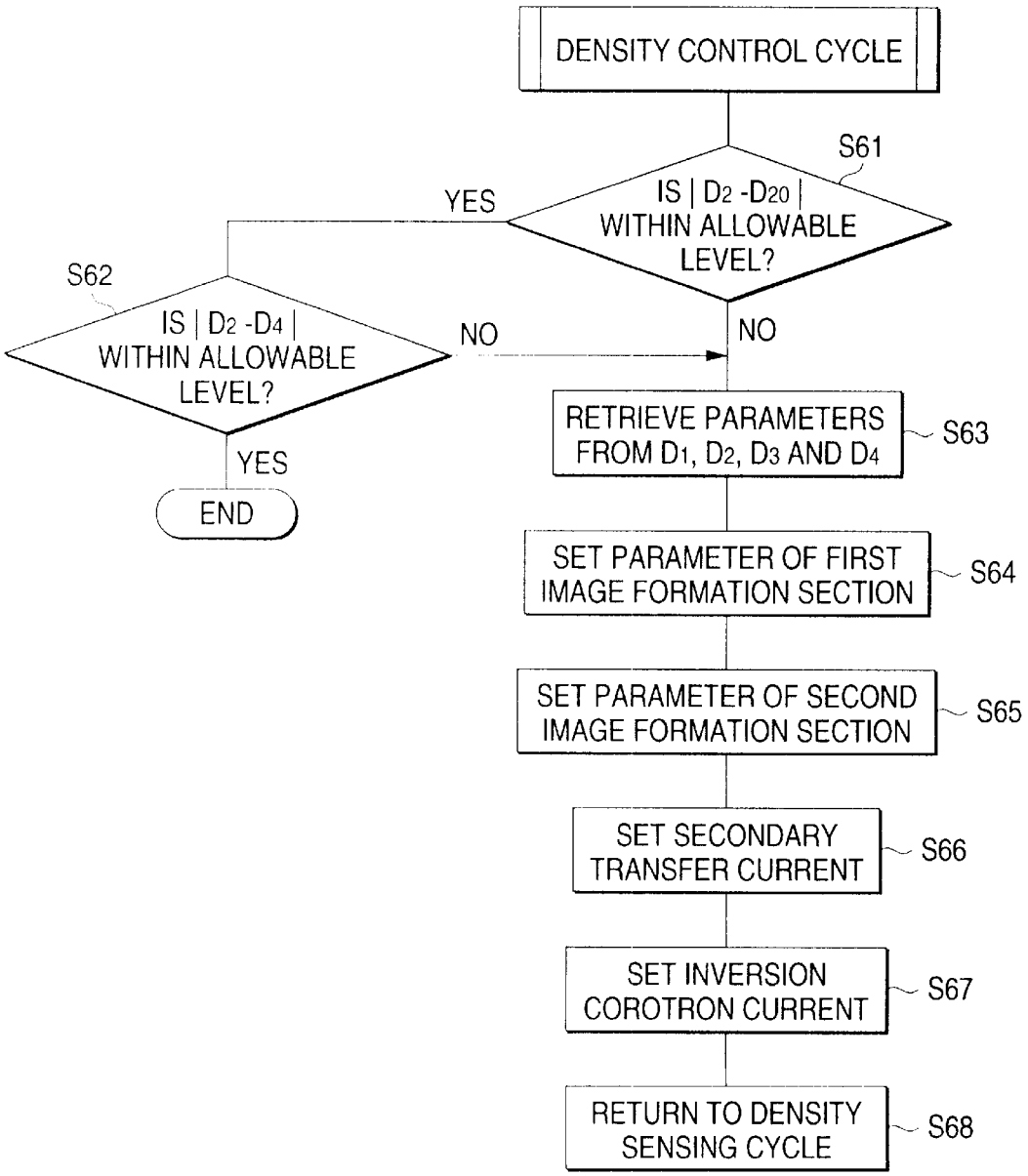
FIG. 11 is a flowchart to show still another specific example of the density control cycle in FIG. 7.

Another modified example of the density control cycle is as shown in FIG. 11.

A predetermined table is referenced based on the sensing signals D1–D4 from the density sensors 101–104 and parameters, such as developing bias as a parameter of each image formation section, secondary transfer current, and inversion corotron current, are set. The density sensing cycle and the density control cycle are repeated, for example, until |D2–D20| (the difference between the secondarily transferred image density in one image formation section and the reference value (D20)) and |D2–D4| (the density difference between secondarily transferred images in the image formation sections) become with allowable level.

When the density is sensed by each density sensor 101–104, preferably the density on the opposed face with no toner patch is also sensed like (patch output)/(output with no patch) and contamination of the density sensors 101–104, contamination of the intermediate transfer belts 25*a* and 25*b*, and the like are removed.

(Second Embodiment)

Figure 12:
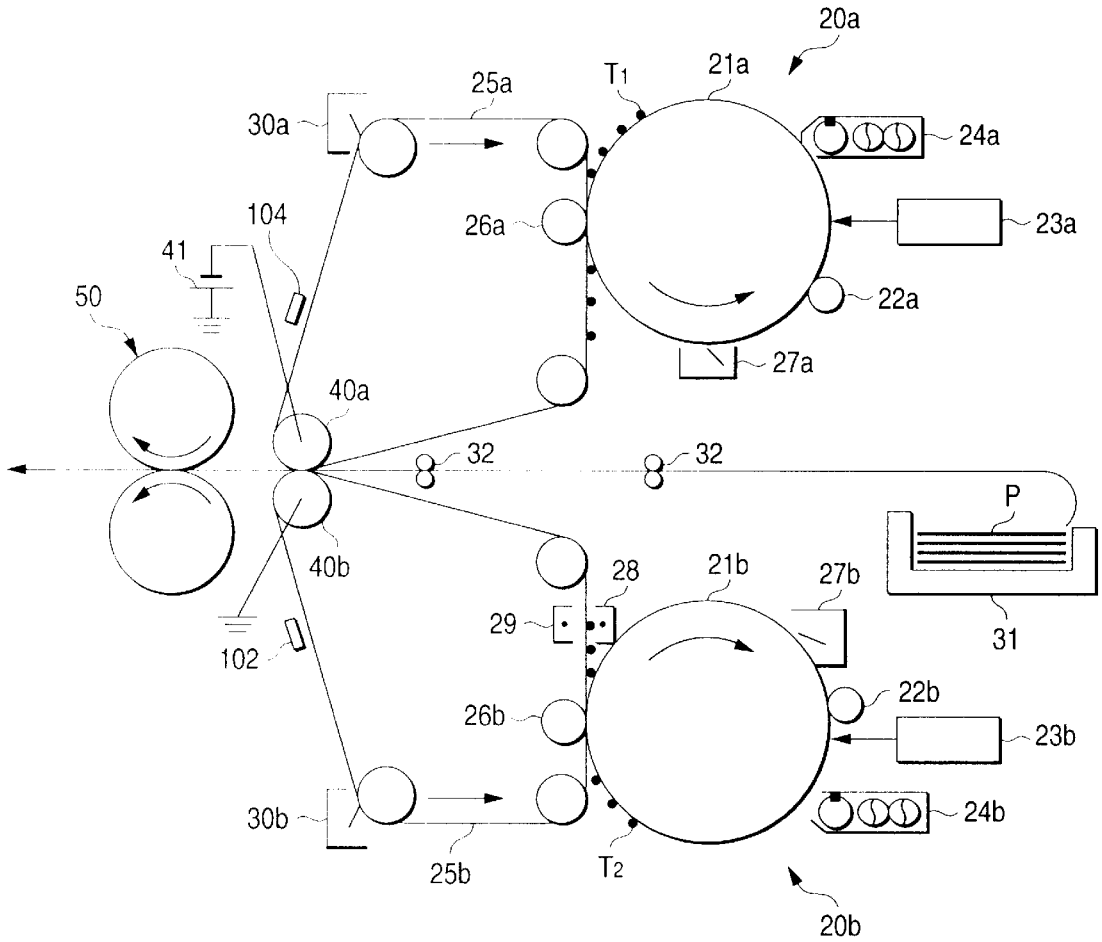
FIG. 12 is a schematic representation to show an outline of a double-sided image formation system according to a second embodiment of the invention.

FIG. 12 shows a second embodiment of a double-sided image formation system incorporating the invention.

The basic configuration of the double-sided image formation system shown in FIG. 12 is roughly the same as that of the first embodiment except that the primary transfer density sensors 101 and 103 are deleted and that secondary transfer density sensors 102 and 104 also serve as the primary transfer density sensors. Parts similar to those previously described with reference to FIG. 5 are denoted by the same reference numerals in FIG. 12 and will not be discussed again in detail.

In the second embodiment, in a density sensing cycle in a density adjustment mode, toner patches T1, T2 for primarily and secondarily transferred images in each image formation section 20*a*, 20*b* are primarily transferred to an intermediate transfer belt 25*a*, 25*b*, then the densities of the primarily and secondarily transferred images by the density sensor 102, 104.

Figure 13A:
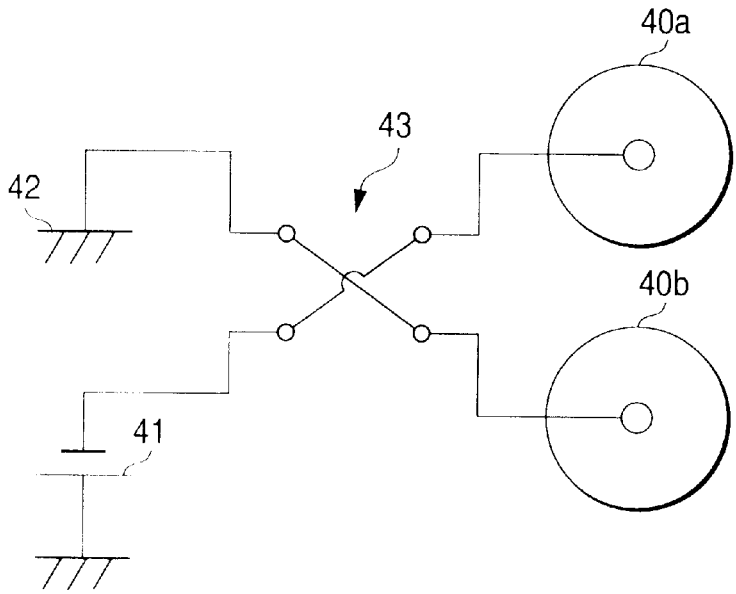
FIGS. 13A and 13B are schematic representations to show details of secondary transfer devices used with the second embodiment of the invention.
Figure 13B:
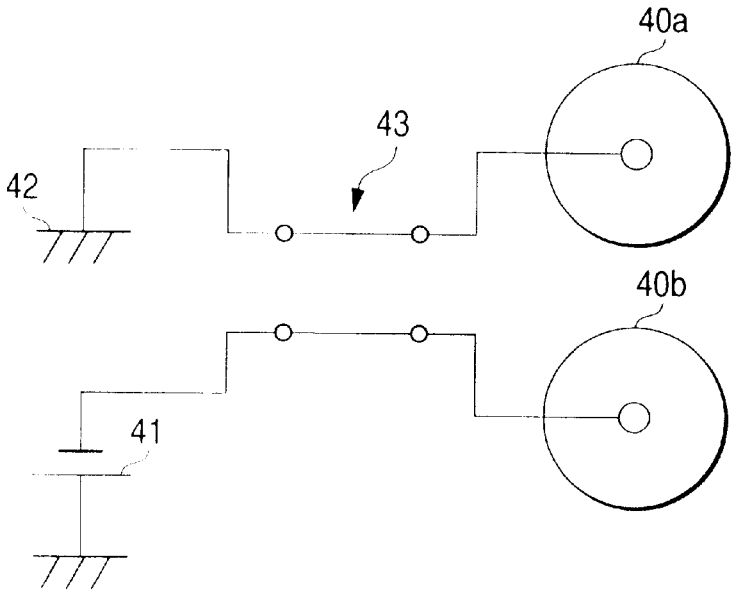

Further, in the embodiment, secondary transfer rolls 40*a* and 40*b* are switched and connected to a transfer bias 41 and ground 42 by a changeover switch 43, as shown in FIG. 13. In a print mode or when the secondarily transferred image density is sensed in the density adjustment mode, the secondary transfer roll 40*a* is connected to the transfer bias 41 and the secondary transfer roll 40*b* is grounded. On the other hand, when the primarily transferred image density is sensed in the density adjustment mode, the secondary transfer roll 40*a* is grounded and the secondary transfer roll 40*b* is connected to the transfer bias 41.

Next, the density adjustment mode operation of the double-sided image formation system according to the embodiment will be discussed.

The second embodiment differs from the first embodiment in the density sensing cycle in the density adjustment mode.

In FIG. 12, a toner patch T1 for primary transfer formed on a first photosensitive drum 21*a* is transferred by a primary transfer roll 26*a* onto the first intermediate transfer belt 25*a* moving roughly at the same speed as the first photosensitive drum 21*a*.

At the secondary transfer part where the first and second intermediate transfer belts 25*a* and 25*b* are close to each other, a reverse bias to the normal transfer bias is applied so that the secondary transfer roll 40*a* is grounded and the transfer bias 41 is applied to the secondary transfer roll 40*b* and paper is not transported. In this state, the toner patch T1 transferred to the first intermediate transfer belt 25*a* is passed through the secondary transfer part.

At this time, the toner patch T1 on the first intermediate transfer belt 25*a* receives an electric field for pressing against the first intermediate transfer belt 25*a*, thus an accident in which the toner patch T1 is transferred to the second intermediate transfer belts 25*b* is blocked reliably.

The density sensor 104 reads the reflected density from the toner patch T1 for primary transfer formed on the first intermediate transfer belt 25*a*, thereby sensing the primary transfer density.

Then, a toner patch T1 for secondary transfer formed on the first photosensitive drum 21*a* is transferred by the primary transfer roll 26*a* onto the first intermediate transfer belt 25*a* moving roughly at the same speed as the first photosensitive drum 21*a*. At the secondary transfer part where the first and second intermediate transfer belts 25*a* and 25*b* are close to each other, the normal bias is applied (the transfer bias is applied to the secondary transfer roll 40*a* and the secondary transfer roll 40*b* is grounded) and paper is not transported. In this state, the transferred toner patch T1 is transferred to the second intermediate transfer belts 25*b* and the density sensor 102 reads the reflected density therefrom, thereby sensing the secondary transfer density.

Likewise, the primary transfer density and the secondary transfer density in the second image formation section 20*b* are sensed.

If the density information thus sensed is used to execute a density control cycle similar to that in the first embodiment, a density adjustment similar to that in the first embodiment is performed.

Therefore, according to the second embodiment, the density adjustment mode similar to that in the first embodiment can be accomplished simply by using the two density sensors 102 and 104.

In the second embodiment, the polarity of the transfer bias in the secondary transfer part is switched, thereby reliably blocking transfer of the toner patch T1 (T2) for primary transfer to the intermediate transfer belt 25*b* (25*a*) on the other side, but the invention is not limited to it. For example, a retract mechanism for temporarily retracting the intermediate transfer belt 25*a*, 25*b* when the toner patch T1 (T2) for primary transfer passes through the secondary transfer part may be installed.

The transfer bias in the secondary transfer part may simply be turned off temporarily for allowing the toner patch T1 (T2) for primary transfer to pass through the secondary transfer part depending on the type of toner used.

Further, in the embodiment, toner patches T1 (T2) for primary transfer and secondary transfer are formed for each of the image formation sections 20*a* and 20*b*, but the invention is not limited to it. One toner patch T1 (T2) may be used for both primary transfer and secondary transfer.

(Third Embodiment)

Figure 14:
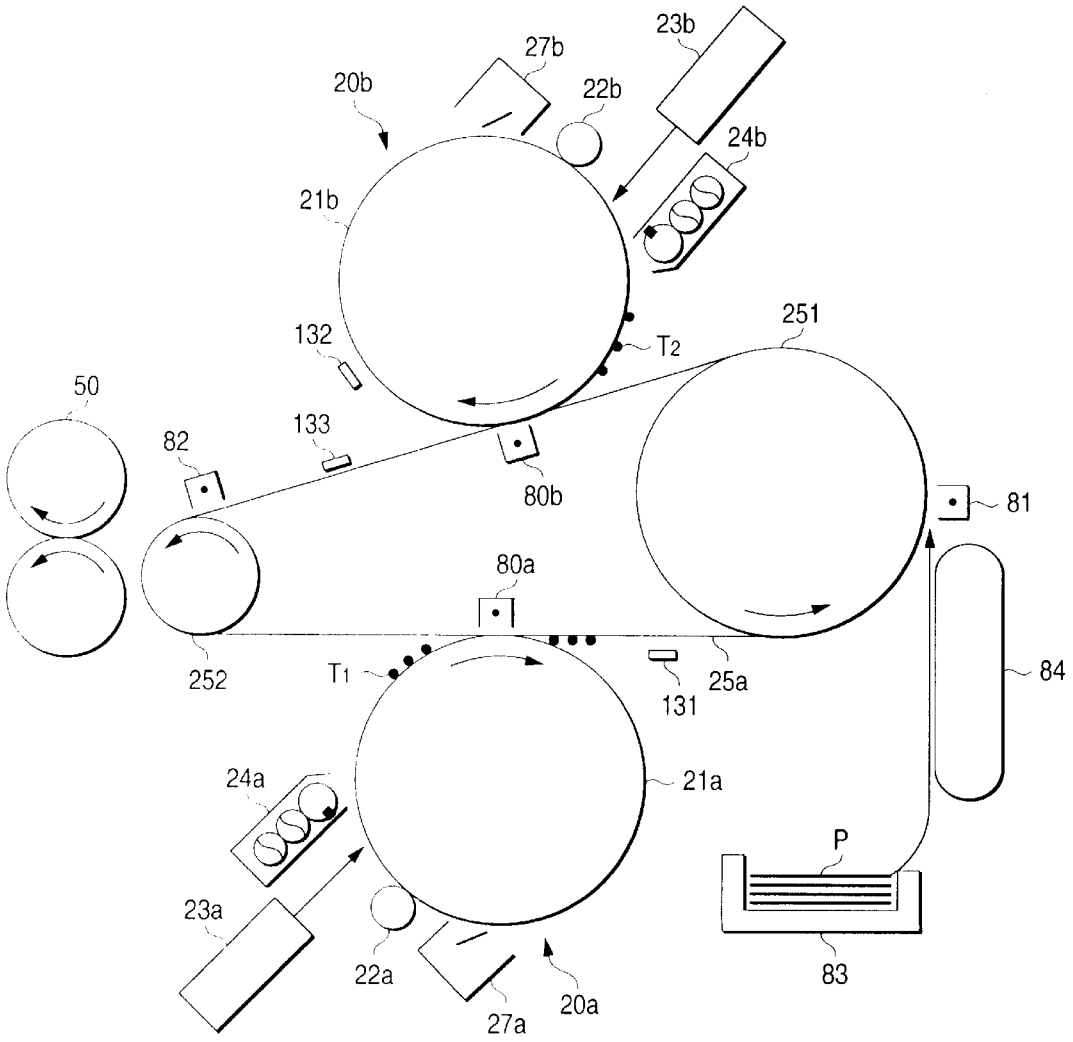
FIG. 14 is a schematic representation to show an outline of a double-sided image formation system according to a third embodiment of the invention.

FIG. 14 shows a third embodiment of a double-sided image formation system incorporating the invention.

In the figure, the double-sided image formation system comprises a first image formation section 20*a* for forming a first image (a photosensitive drum 21*a*, a charge device 22*a*, an exposure device 23*a*, a developing device 24*a*, an intermediate transfer belt 25*a*, a transfer device 80*a* such as a transfer corotron, a cleaning device 27*a*, etc.,), a second image formation section 20*b* (a photosensitive drum 21*b*, a charge device 22*b*, an exposure device 23*b*, a developing device 24*b*, a transfer device 80*b* such as a transfer corotron, a cleaning device 27*b*, etc.,), and a fuser 50 for fusing the images on paper P passing through the first and second image formation sections 20*a* and 20*b*.

In the embodiment, the transfer device 80*a* such as a transfer corotron in the first image formation section 20*a* is a device for primarily transferring a first image T1 on the photosensitive drum 21*a* to the intermediate transfer belt 25*a*. An attraction transfer corotron 81 is provided at the part facing a paper attraction part at a midpoint of the intermediate transfer belt 25*a* from a transfer part in the first image formation section 20*a* to a transfer part in the second image formation section 20*b* for electrostatically attracting paper P onto the intermediate transfer belt 25*a* and secondarily transferring an image on the intermediate transfer belt 25*a* to the paper P.

Numeral 82 is a striping corotron for stripping off the paper P attracted onto the intermediate transfer belt 25*a*, numeral 83 is a paper tray, and numeral 84 is a transport for vertically transporting paper P in the paper tray 83 to the paper attraction part of the intermediate transfer belt 25*a*, such as a vacuum transport.

The intermediate transfer belt 25*a* is placed on a drive roll 251 and a driven roll (tension roll for tension adjustment) 252 and the transfer devices 80*a* and 80*b* in the first and second image formation sections 20*a* and 20*b* are disposed on the rear of the intermediate transfer belt 25*a*.

In the embodiment, the following density sensors are disposed: A primary transfer density sensor 131 for sensing the density of an image primarily transferred from the first photosensitive drum 21*a* to the intermediate transfer belt 25*a*, a secondary transfer density sensor 132 for sensing the density of an image secondarily transferred from the intermediate transfer belt 25*a* to the second photosensitive drum 21*b*, and a density sensor 133 for sensing the density of an image transferred from the second photosensitive drum 21*b* to the intermediate transfer belt 25*a*.

Particularly, in the embodiment, the density sensors 131–133 are optical sensors placed facing the image support face of the intermediate transfer belt 25*a* or the second photosensitive drum 21*b*; the primary transfer density sensor 131 is placed downstream from the primary transfer position of the intermediate transfer belt 25*a* and upstream from the paper attraction position (secondary transfer position), the secondary transfer density sensor 132 is placed downstream from the transfer part of the second photosensitive drum 21*b*, and the density sensor 133 is placed downstream from the transfer part of the second photosensitive drum 21*b* on the intermediate transfer belt 25*a*.

Next, an image formation process of the double-sided image formation system according to the embodiment will be discussed.

First, a first image T1 formed on the first photosensitive drum 21*a* is transferred by the transfer device 80*a* onto the intermediate transfer belt 25*a* moving roughly at the same speed as the photosensitive drum 21*a*. On the other hand, paper P from the paper tray 83 is transported through the transport 84 to the paper attraction part on the intermediate transfer belt 25*a* at the matched timing, the image T1 on the intermediate transfer belt 25*a* is transferred onto a first side of the paper P by the attraction transfer corotron 81, and the paper P is attracted onto the intermediate transfer belt 25*a* as it is.

Subsequently, a second image T2 is formed on the second photosensitive drum 21*b* in synchronization with turn of the intermediate transfer belt 25*a* and is transferred onto a second side of the paper P by the transfer device 80*b*.

After this, the paper P is stripped off from the intermediate transfer belt 25*a* by the striping corotron 82, then both sides of the paper P are fused by the fuser 50 at the same time.

A density adjustment mode in the double-sided image formation system in such an image formation process is executed, for example, as follows:

Now, assuming that the density adjustment mode is started in association with a density adjustment start signal, first a density sensing cycle is executed.

A first toner patch T1 formed on the first photosensitive drum 21*a* is transferred by the transfer device 80*a* onto the first intermediate transfer belt 25*a* moving roughly at the same speed as the first photosensitive drum 21*a*. The density of the transferred toner patch T1 is sensed by reading the reflected density therefrom by the primary transfer density sensor 131, then at the transfer part between the first intermediate transfer belt 25*a* and the second photosensitive drum 21*b*, for example, the polarity of the transfer bias of the transfer device 80*b* is switched and the paper is not transported. In this state, the toner patch T1 is transferred to the second photosensitive drum 21*b* and the density of the toner patch T1 transferred onto the second photosensitive drum 21*b* is read by the secondary transfer density sensor 132.

On the other hand, the paper P is not transported and a second toner patch T2 formed on the second photosensitive drum 21*b* is transferred by the transfer device 80*b* onto the first intermediate transfer belt 25*a* moving roughly at the same speed as the second photosensitive drum 21*b*. The density of the transferred toner patch T2 is sensed by reading the reflected density therefrom by the density sensor 133.

Here, assuming that the density information pieces sensed by the density sensors 131–133 are D1 to D3 respectively, after the density sensing cycle is performed, a density control cycle similar to that in the first embodiment is executed for making density adjustments so that the final image densities D2 and D3 in the image formation sections 20*a* and 20*b* match for correcting parameters of the image formation sections 20*a* and 20*b* appropriately.

(Fourth Embodiment)

Figure 15:
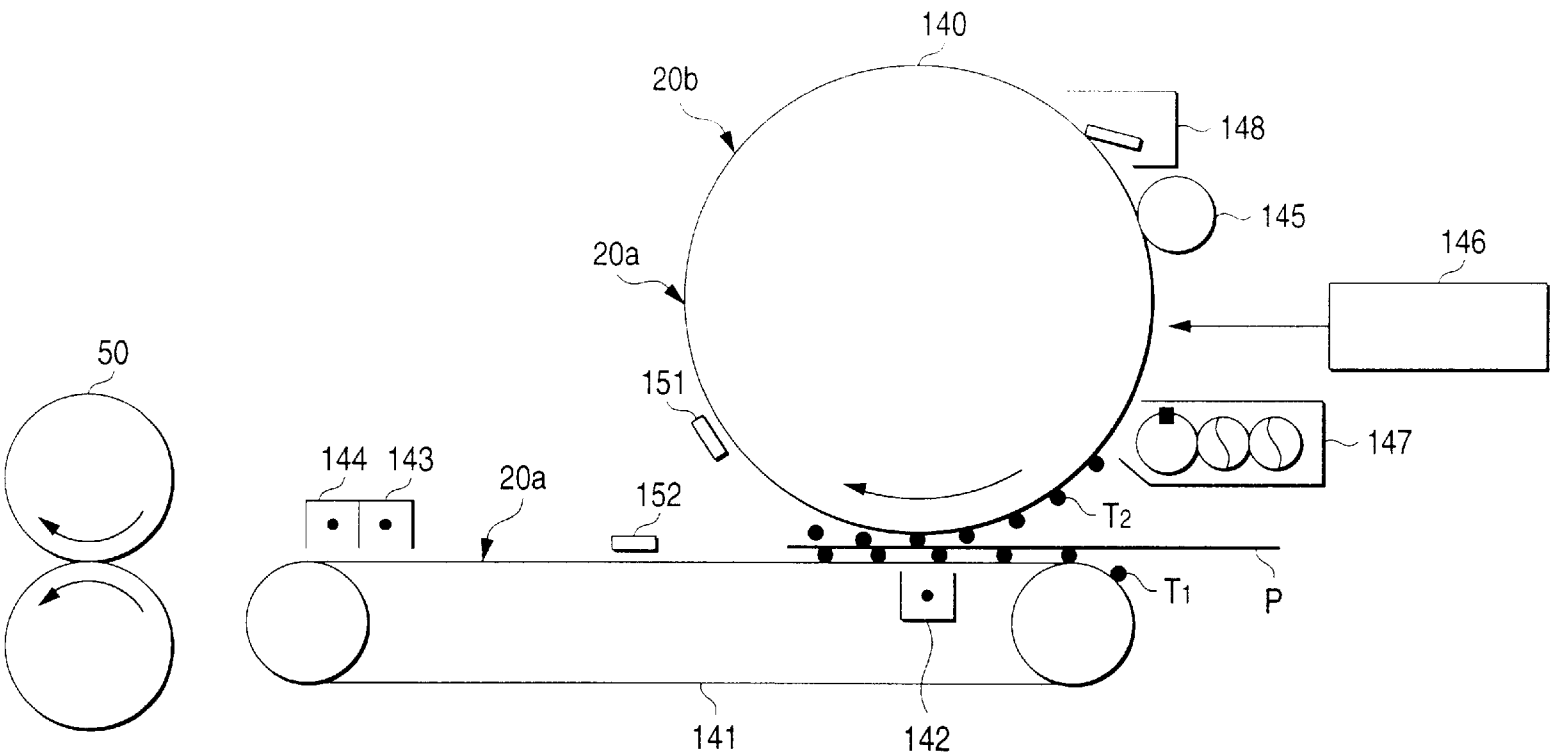
FIG. 15 is a schematic representation to show an outline of a double-sided image formation system according to a fourth embodiment of the invention.

FIG. 15 shows a fourth embodiment of a double-sided image formation system incorporating the invention.

In the figure, the double-sided image formation system comprises a photosensitive drum 140 for supporting a first image T1 and a second image T2, an intermediate transfer belt 141 for once holding the first image, a first transfer device being disposed in a first transfer part for transferring the images T1 and T2 on the photosensitive drum 140 to the intermediate transfer belt 141 or paper P, a second transfer device 143 and a paper stripping device 144 being disposed at the paper discharge end of the intermediate transfer belt 141, the second transfer device 143 for transferring the first image T1 on the intermediate transfer belt 141 to the paper P, and a fuser 50 disposed following the paper stripping device 144. Numeral 145 is a charge device, numeral 146 is an exposure device, numeral 147 is a developing device, and numeral 148 is a cleaning device.

In the embodiment, a density sensor 151 is disposed downstream from the transfer part of the photosensitive drum 140 and a density sensor 152 is disposed downstream from the transfer part of the intermediate transfer belt 141. A density adjustment mode is executed based on sensing information input from the density sensors 151 and 152.

In the density adjustment mode in the embodiment, paper is not transported and a first toner patch T1 formed in a first image formation section 20*a* (functional section using the photosensitive drum 140 and the intermediate transfer belt 141 to form an image) is primarily transferred to the intermediate transfer belt 141, then a first primary transfer density D1 is sensed by the density sensor 152 and the toner patch T1 is again transferred from the intermediate transfer belt 141 to the photosensitive drum 140, then a density D2 of the first toner patch T1 is sensed by the density sensor 151. On the other hand, a second toner patch T2 formed in a second image formation section 20*b* (functional section using only the photosensitive drum 140 to form an image) is transferred from the photosensitive drum 140 to the intermediate transfer belt 141, then a density D3 of the second toner patch T2 is sensed by the density sensor 152.

Here, after the density sensing cycle is performed, the density information pieces sensed by the density sensors 151 and 152, D1, D2, and D3, are used to execute a density control cycle similar to that in the first embodiment for making density adjustments so that the final image densities D2 and D3 in the image formation sections 20*a* and 20*b* match for correcting parameters of the image formation sections 20*a* and 20*b* appropriately.

(Fifth Embodiment)

Figure 16:
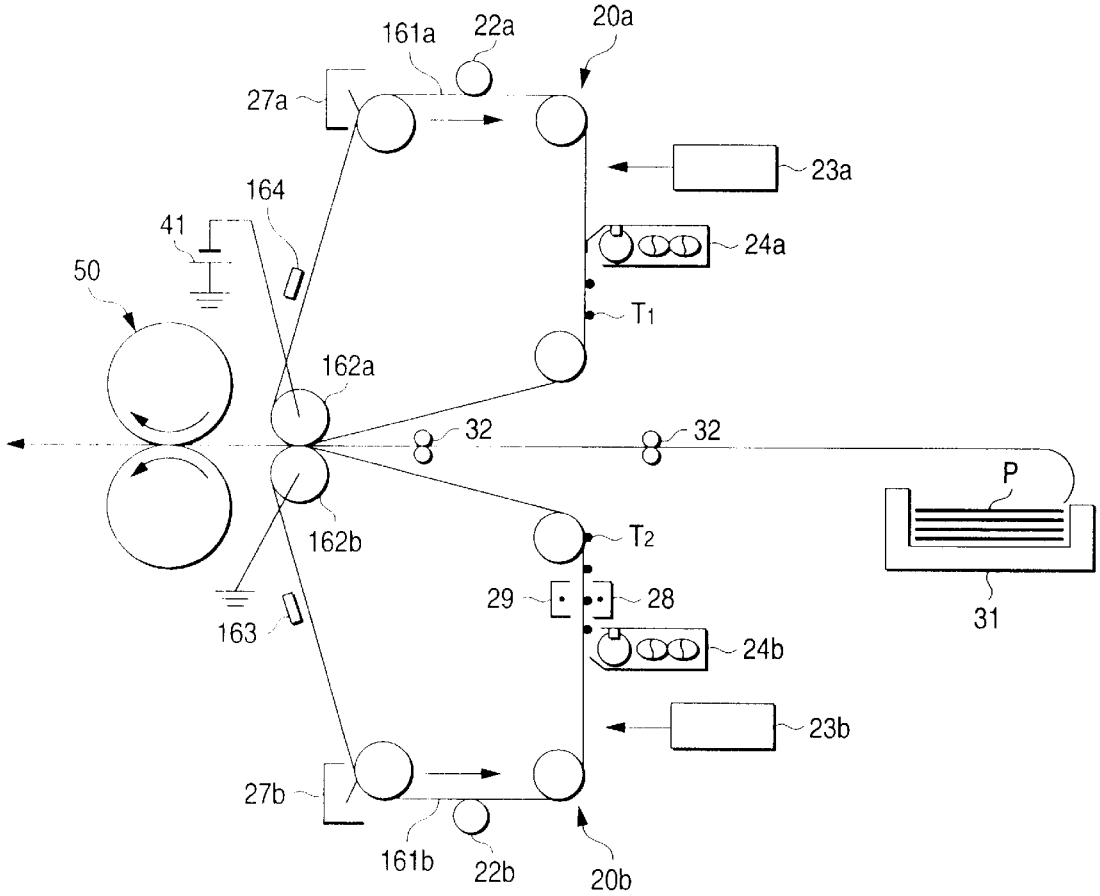
FIG. 16 is a schematic representation to show an outline of a double-sided image formation system according to a fifth embodiment of the invention.

FIG. 16 shows a fifth embodiment of a double-sided image formation system incorporating the invention.

In the figure, the double-sided image formation system comprises a first image formation section 20*a* for forming a first image on a first side of paper P, a second image formation section 20*b* for forming a second image on a second side of paper P, and a fuser 50 for fusing the images on the paper P passing through the first and second image formation sections 20*a* and 20*b* like the double-sided image formation system of the first or second embodiment. However, the first image formation section 20*a* does not use intermediate transfer belt 25*a* and the second image formation section 20*b* does not use intermediate transfer belt 25*b* unlike the image formation sections in the first or second embodiment.

That is, in the embodiment, the image formation section 20*a*, 20*b* comprises a photosensitive belt 161*a*, 161*b* placed on a proper number of rolls and circulated, a charge roll 22*a*, 22*b* for charging the surface of the photosensitive belt 161*a*, 161*b*, an exposure device 23*a*, 23*b* for writing an electrostatic latent image for a first image, a second image onto the charged photosensitive belt 161*a*, 161*b*, a developing device 24*a*, 24*b* for visualizing the electrostatic latent image written onto the photosensitive belt 161*a*, 161*b* in toner, a transfer roll 162*a*, 162*b* for transferring a toner image T1, T2 on the photosensitive belt 161*a*, 161*b* (for example, a positive image in the embodiment) onto paper P, and a cleaner 27*a*, 27*b* for removing the remaining toner on the photosensitive belt 161*a*, 161*b*.

A pair of inversion corotrons 28 and 29 is placed facing each other with the photosensitive belt 161*b* between downstream from the developing position of the photosensitive belt 161*b* in the second image formation section 20*b* and upstream from the transfer position.

Further, in the embodiment, density sensors 163 and 164 are disposed downstream from the transfer parts of the photosensitive belts 161*a* and 161*b*. A density adjustment mode is executed based on sensing information input from the density sensors 163 and 164.

In the density adjustment mode in the embodiment, first, paper is not transported and an electric field given to the transfer roll 162*a*, 162*b* in double-sided transfer section is inverted so as not to transfer a first toner patch T1 formed in the first image formation section 20*a*, then a before-transfer patch density D1 of the first toner patch T1 is sensed by the density sensor 164. Likewise, a before-transfer patch density D2 of a second toner patch T2 formed in the second image formation section 20*b* is also sensed by the density sensor 163.

Next, the first toner patch T1 formed in the first image formation section 20*a* is transferred from the first photosensitive belt 161*a* to the second photosensitive belt 161*b*, then a density D3 of the first toner patch T1 is sensed by the density sensor 163. On the other hand, the second toner patch T2 formed in the second image formation section 20*b* is transferred from the second photosensitive belt 161*b* to the first photosensitive belt 161*a*, then a density D4 of the second toner patch T2 is sensed by the density sensor 164.

Here, after the density sensing cycle is performed, the density information pieces sensed by the density sensors 163 and 164, D1, D2, D3, and D4 are used to execute a density control cycle similar to that in the first embodiment for making density adjustments so that the final image densities D3 and D4 in the image formation sections 20*a* and 20*b* match for correcting parameters of the image formation sections 20*a* and 20*b* appropriately.

(Sixth Embodiment)

Figure 17:
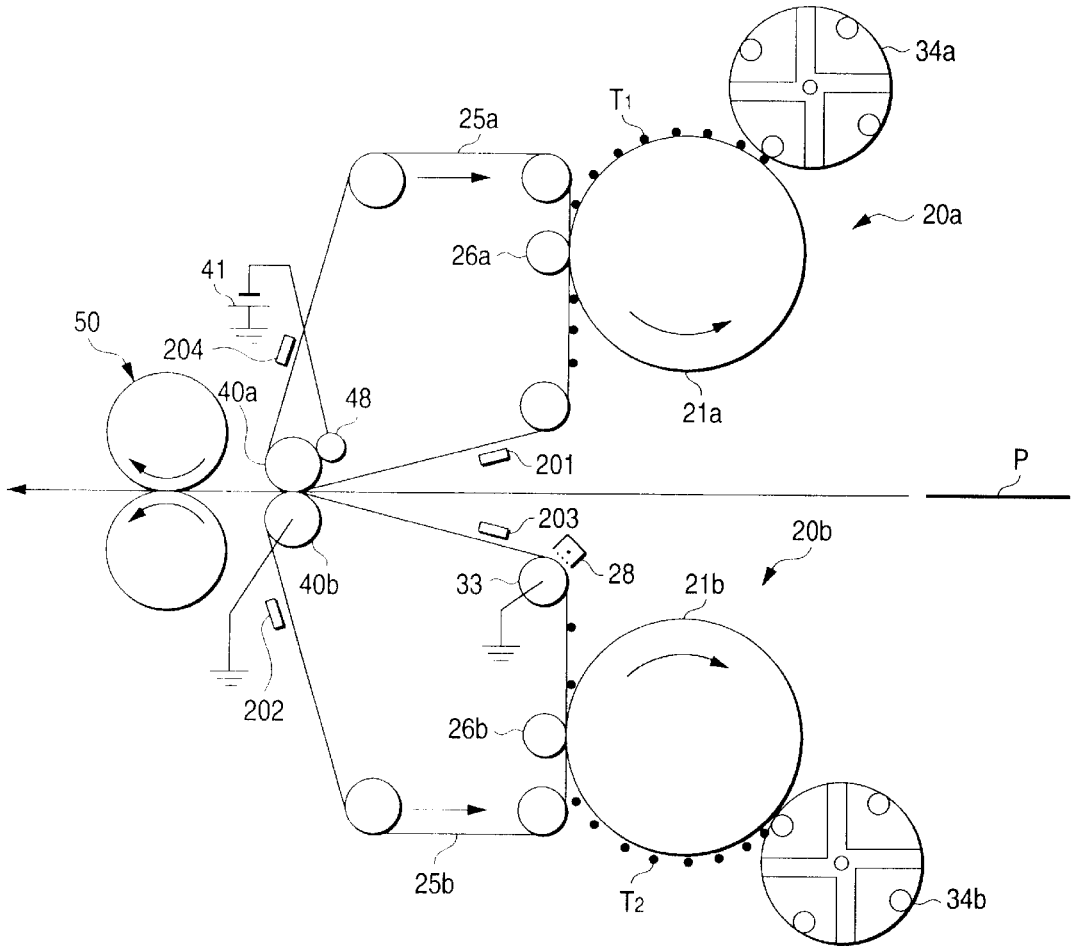
FIG. 17 is a schematic representation to show an outline of a double-sided image formation system according to a sixth embodiment of the invention.

FIG. 17 shows a sixth embodiment of a double-sided image formation system incorporating the invention.

In the figure, the double-sided image formation system has a basic configuration roughly similar to that in the first embodiment. The sixth embodiment differs from the first embodiment in the following points: Full color (in the embodiment, yellow (Y), magenta (M), cyan (C), and black (K)) rotary developing devices 34*a* and 34*b* are installed and as a bias application method to a secondary transfer roll 40*a*, a contact roll 48 coming in contact with the secondary transfer roll 40*a* is provided for applying a bias to the secondary transfer roll 40*a*, and further a mechanism 60 for attaching and detaching secondary transfer rolls 40*a* and 40*b* (see FIG. 18) is installed.

In the embodiment, the secondary transfer roll 40*a* comprises a metal shaft coated with insulation EPDM rubber coated on the surface with a thin film of conductive EPDM rubber with surface resistance set to $10^9\Omega/cm^2$, and the contact roll 48 is a metal shaft. The secondary transfer roll 40*b* comprises a metal shaft coated with carbon black dispersed in EPDM rubber with volume resistivity set to $10^5\Omega\cdot$cm.

Rubber, a resin, etc., with volume resistivity set to $10^{11}\Omega\cdot$cm or more can be used for the insulating layer and in addition, a material comprising conductive particles of carbon black, etc., dispersed in pVdF, polyester, acrylic, or the like can be used for the conductive thin film; preferably, surface resistance is set to $10^8$–$10^{10}\Omega/\text{cm}^2$.

Figure 18:
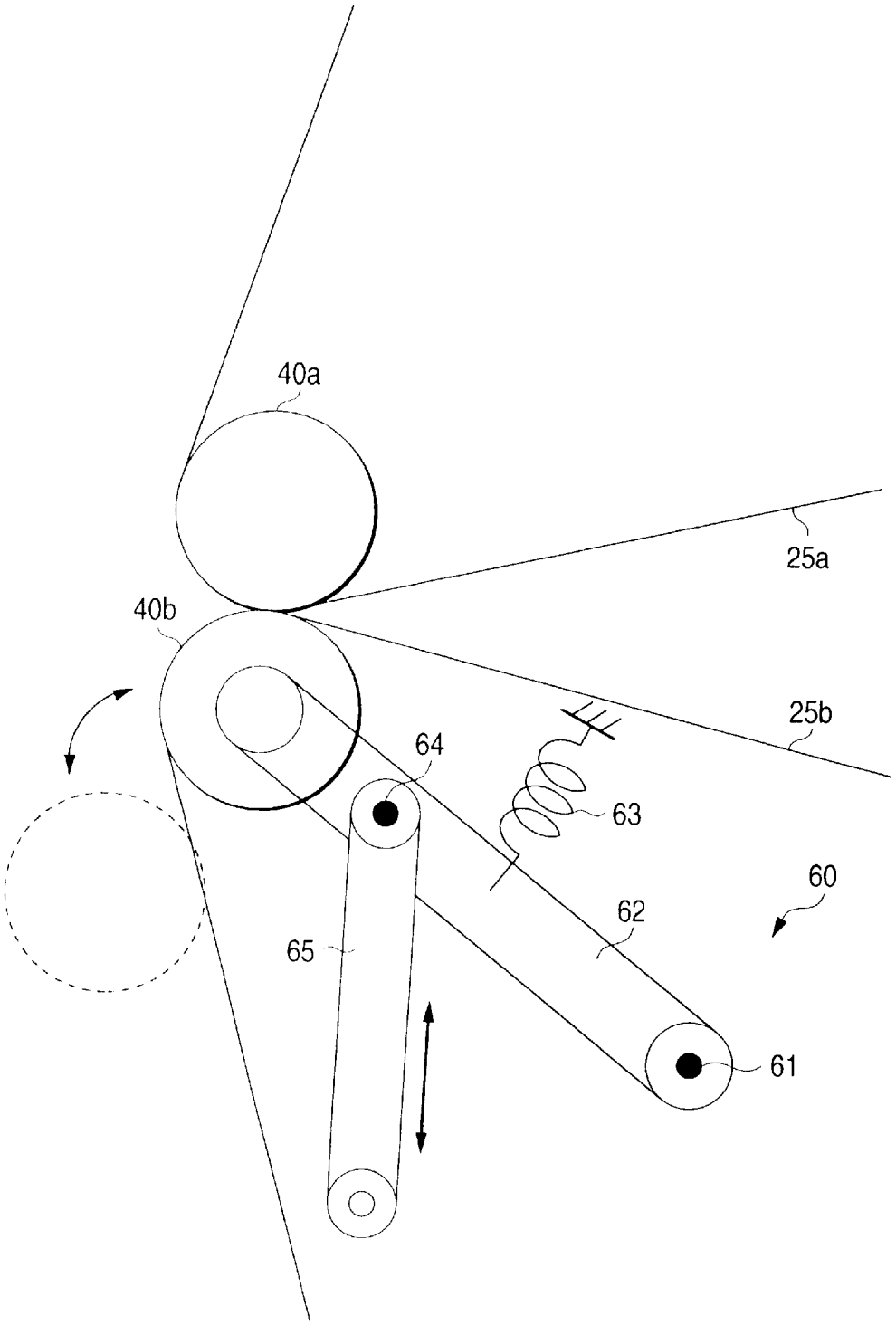
FIG. 18 is a schematic representation to show details of secondary transfer devices used with the sixth embodiment of the invention.

The mechanism 60 between the secondary transfer rolls 40*a* and 40*b* will be discussed with reference to FIG. 18.

In the embodiment, the first secondary transfer roll 40*a* is fixed and the second secondary transfer roll 40*b* is moved.

The second secondary transfer roll 40*b* is held on a lever 62 with a supporting point 61 as the center and pressurized by a spring 63. A lever 65 coupled with the lever is moved at a supporting point 64, thereby moving the second secondary transfer roll 40*b*, thereby attaching or detaching the secondary transfer rolls 40*a* and 40*b*.

Further, in the embodiment, negative-charged toner is used as the toners T1 and T2, direct current +10 $\mu$A is applied to a primary transfer roll 26*a*, 26*b* for each transfer of YMCK, direct current +300 $\mu$A and grid voltage +500 V are applied to an inversion corotron 28, and DC voltage −2 kV is applied to the contact roll 48 coming in contact with the secondary transfer roll 40*a*. The secondary transfer roll 40*b* is grounded.

The circumferential length of the intermediate transfer belt 25*a*, 25*b* is made twice that of a photosensitive drum 21*a*, 21*b*, but preferably is made an integral multiple of the circumferential length of the photosensitive drum 21*a*, 21*b* to avoid a color shift.

In the embodiment, the following color sensors are disposed: A primary transfer color sensor 201 for sensing the color of an image primarily transferred to the intermediate transfer belt 25*a*, a secondary transfer color sensor 202 for sensing the color of an image secondarily transferred from one intermediate transfer belt 25*a* to the other intermediate transfer belt 25*b* by the secondary transfer rolls 40 (40*a* and 40*b*), a primary transfer color sensor 203 for sensing the color of an image primarily transferred to the intermediate transfer belt 25*b*, and a secondary transfer color sensor 204 for sensing the color of an image secondarily transferred from one intermediate transfer belt 25*b* to the other intermediate transfer belt 25*a* by the secondary transfer rolls 40.

Particularly, in the embodiment, the color sensors 201–204 are optical sensors which are placed facing the image support face of the intermediate transfer belt 25*a* or 25*b* and can sense the densities of color component images of Y, M, and C as well as K; the primary transfer color sensors 201 and 203 are placed downstream from the primary transfer position and upstream from the secondary transfer position and the secondary transfer color sensors 202 and 204 are placed downstream from the secondary transfer position.

A color adjustment system for matching the color of an image on one side of paper P with that on the other side is a microcomputer system roughly similar to that shown in FIG. 6. It executes a color adjustment program in association with a color adjustment start signal (not shown), senses the colors of patch images formed in the image formation sections 20*a* and 20*b* by the color sensors 201–204, generates control signals for adjusting parameters of the image formation sections 20*a* and 20*b* so as to match the color of the patch image on one side of paper with that on the other side based on the sensing signals, and controls a first developing bias, a second developing bias, a secondary transfer current, and an inversion corotron current, for example, for each color component of Y, M, and C.

Next, the operation of the double-sided image formation system according to the embodiment is as follows:

First, an image formation process associated with the normal print mode will be discussed.

With the secondary transfer rolls 40*a* and 40*b* detached from each other, a first toner image T1 formed in the order of YMCK on the first photosensitive drum 21*a* is transferred by the primary transfer roll 26*a* onto the first intermediate transfer belt 25*a* in sequence one color at one revolution. Likewise, a second toner image T2 (YMCK) formed on the second photosensitive drum 21*b* is transferred onto the second intermediate transfer belt 25*b* by the primary transfer roll 26*b* in sequence, then voltage is applied to the inversion corotron 28 placed facing a tension roll 33 grounded, thereby inverting the polarity of the second toner image T2.

After the third color, cyan, transferred onto the intermediate transfer belt 25*a*, 25*b* passes through the secondary transfer part, the secondary transfer rolls 40*a* and 40*b* are brought into contact with each other and paper P is transported at the matched timing. The toner images T1 and T2 on the intermediate transfer belts 25*a* and 25*b* are transferred onto the paper P at the same time, then the toner images on both sides of the paper P are fused by the fuser 50 at the same time.

The remaining toner on the intermediate transfer belts 25*a* and 25*b* is removed by belt cleaners 30*a* and 30*b*.

Figure 19:
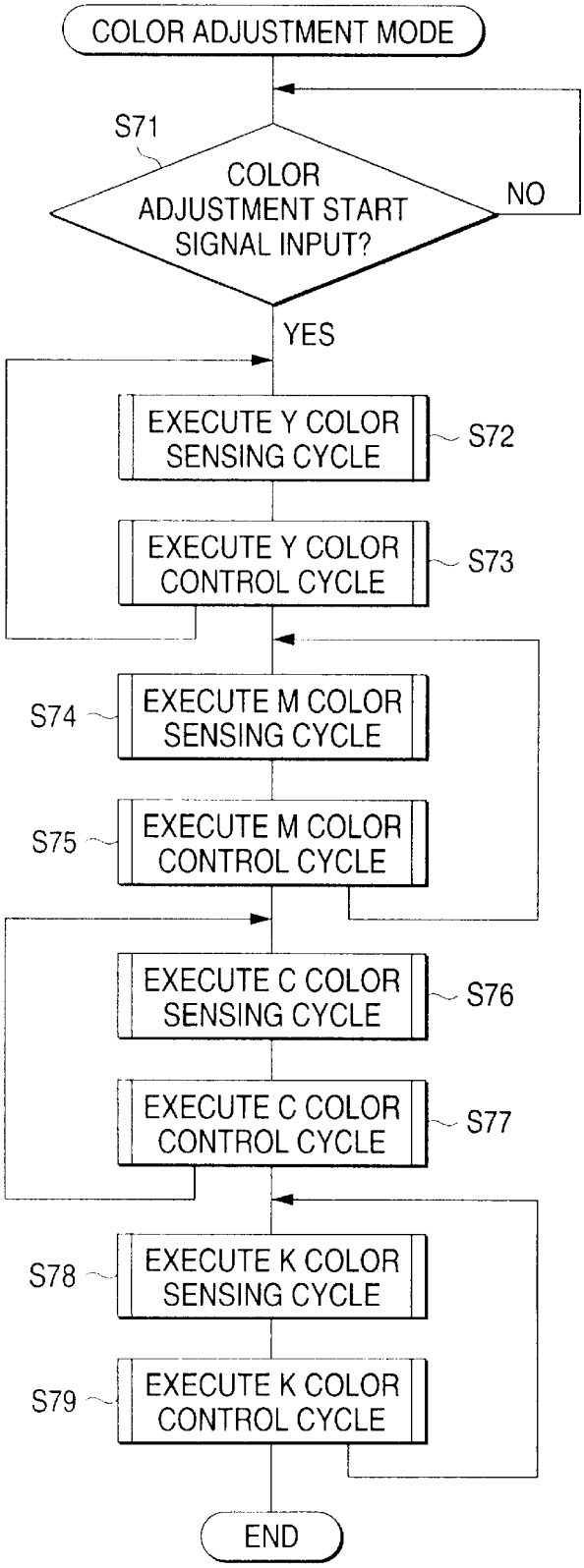
FIG. 19 is a flowchart of a color adjustment mode used in the first embodiment of the invention.

FIG. 19 shows a color adjustment mode for making the same colors of images on both sides, provided aside from the print mode as described above.

The color adjustment mode is executed each time power of the image formation system is turned on (at the print cycle start time) or is turned off (at the print cycle end time) or at an appropriate timing during the print cycle (for example, every predetermined number of print sheets); a color sensing cycle and a color control cycle are executed for each color component (Y, M, C, K). In FIG. 19, the color adjustment start signal is an image formation system power on or off signal or a signal indicating that the number of print sheets reaches the predetermined number of sheets.

Now, assuming that the color adjustment mode is started in association with the color adjustment start signal, first a Y color sensing cycle (see FIG. 20) is executed.

Figure 20:
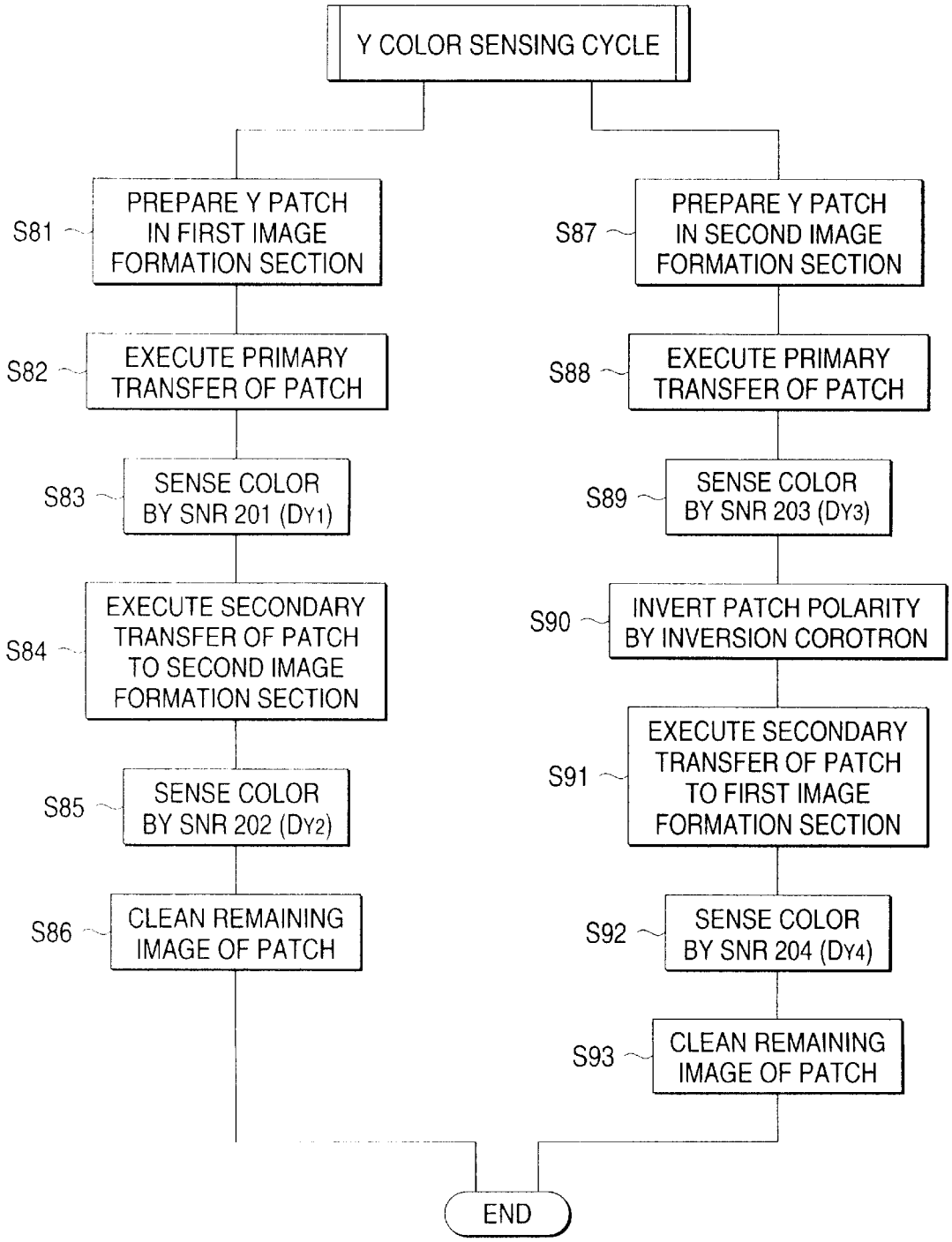
FIG. 20 is a flowchart to show a specific example of the Y color sensing cycle in FIG. 19.

In FIG. 20, a first Y toner patch T1 formed on the first photosensitive drum 21*a* is transferred by the primary transfer roll 26*a* onto the first intermediate transfer belt 25*a* moving roughly at the same speed as the first photosensitive drum 21*a*. The density of the transferred toner patch T1 is sensed by reading the reflected density therefrom by the primary transfer color sensor 201, then at the secondary transfer part where the first and second intermediate transfer belts 25*a* and 25*b* are close to each other, without transporting paper, the first toner patch T1 is transferred to the second intermediate transfer belt 25*b* and the density of the toner patch T1 transferred onto the second intermediate transfer belt 25*b* is read by the secondary transfer color sensor 202.

Here, sensing signals of the color sensors 201 and 202 are DY1 and DY2.

The remaining image of the toner patch T1 on the second intermediate transfer belt 25*b* is removed by the second belt cleaner 30*b*.

Likewise, a second Y toner patch T2 formed on the second photosensitive drum 21*b* is transferred by the primary transfer roll 26*b* onto the second intermediate transfer belt 25*b* moving roughly at the same speed as the second photosensitive drum 21*b*. Voltage is applied to a pair of inversion corotrons 28 and 29 placed with the second intermediate transfer belt 25*b* between, thereby inverting the polarity of the second toner patch T2. The density of the transferred toner patch T2 is sensed by reading the reflected density therefrom by the primary transfer color sensor 203, then at the secondary transfer part where the first and second intermediate transfer belts 25*a* and 25*b* are close to each other, without transporting paper, the toner patch T2 is transferred to the first intermediate transfer belt 25*a* and the density of the toner patch T2 transferred onto the first intermediate transfer belt 25*a* is read by the secondary transfer color sensor 204.

Here, sensing signals of by the color sensors 203 and 204 are DY3 and DY4.

The remaining image of the toner patch T2 on the first intermediate transfer belt 25*a* is removed by the first belt cleaner 30*a*.

Upon completion of such a Y color sensing cycle, then a Y color control cycle (see FIG. 21) is executed.

Figure 21:
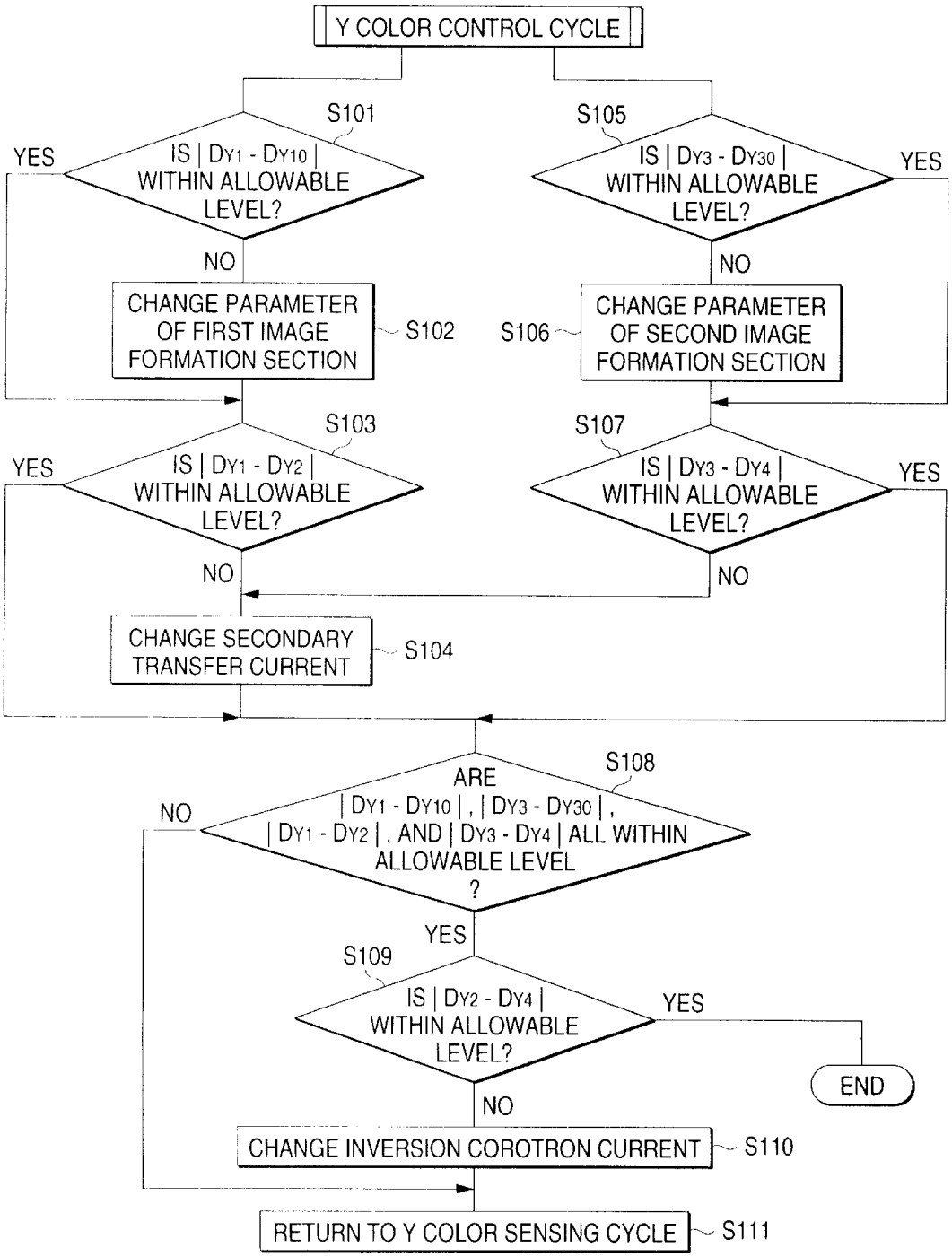
FIG. 21 is a flowchart to show a specific example of the Y color control cycle in FIG. 19.

In FIG. 21, the densities sensed by the primary transfer color sensors 201 and 203 (DY1 and DY3) are compared with the same reference values (DY10 and DY30 (=DY10) and if the difference between DY1 and DY10, DY3 and DY30 exceeds an allowable level, the parameter of the corresponding image formation section 20*a*, 20*b* (in the embodiment, for example, developing bias of developing device 24*a*, 24*b*) is controlled for making a correction so that the densities of the images on both sides become the same.

The parameter of the image formation section 20*a*, 20*b* to be controlled is not limited to the developing bias and one or more of parameters of the charge amount of a charge roll 22*a*, 22*b*, the light quantity of an exposure device 23*a*, 23*b*, the transfer current value of the primary transfer roll 26*a*, 26*b*, and the like may be selected appropriately.

Further, the density difference between the primarily and secondarily transferred images in the image formation section 20*a* (|DY1–DY2|) and that in the image formation section 20*b* (|DY3–DY4|) are found and if at least either of the differences exceeds an allowable level, the secondary transfer current is controlled for making a correction so that the secondary transfer condition becomes proper.

Further, whether or not the densities sensed by the secondary transfer color sensors 202 and 204 (DY2 and DY4) finally under the condition that |DY1–DY10|, |DY3–DY30|, |DY1–DY2|, and |DY3–DY4| are all within the allowable level are at the same level is determined. If the difference between DY2 and DY4 exceeds an allowable level, the voltage applied to the inversion corotron 28 placed on the second intermediate transfer belt 25*b* side (corresponding to inversion corotron current) is controlled for making a correction so that the densities of the images on both sides become the same.

In FIG. 21, if any of the first developing bias, the second developing bias, the second transfer current, or the inversion corotron current is changed, control returns again to the Y color sensing cycle and the Y color sensing cycle and the Y color control cycle are repeated until |DY1–DY10|, |DY3–DY30|, |DY1–DY2|, |DY3–DY4|, and |DY2–DY4| become all within the allowable levels (the densities of the primarily transferred images, the secondarily transferred images on both sides equal).

Upon completion of the Y color density adjustment, then as shown in FIG. 19, an M color sensing cycle and an M color control cycle are executed and upon completion of the M color density adjustment, a C color sensing cycle and a C color control cycle are executed. Upon completion of the C color density adjustment, a K color sensing cycle and a K color control cycle are executed and when the K color density adjustment is complete, the color adjustment mode is complete. In the M, C, or K color sensing cycle, a process roughly similar to that in FIG. 20 is executed except that the toner patch formation color is M, C, or K. In the M, C, or K color control cycle, a process roughly similar to that in FIG. 21 is executed except that the toner patch formation color is M, C, or K.

That is, in the embodiment, the density of an image on one side of paper is matched with that on the other side for each color component (Y, M, C, K), whereby the color of the image on one side of paper is matched with that on the other side with the color components (Y, M, C, K) mixed and the black image density of the image on one side is matched with that on the other side.

In the Y color control cycle in FIG. 21, the first developing bias and the second developing bias are changed based on the densities of the primarily transferred images, but the invention is not limited to it. For example, the densities sensed by the secondary transfer color sensors 202 and 204 (DY2 and DY4) are compared with the same reference values (DY20 and DY40 (=DY20) and if the difference between DY2 and DY20, DY4 and DY40 exceeds an allowable level, the corresponding developing bias or any other parameter may be controlled.

In the embodiment, the Y (M, C, K) color control cycle adopts the method of matching the colors of images on both sides with the same reference values, but the invention is not limited to it. For example, as shown in FIG. 10, after the image density in one image formation section 20*a* is matched with the reference value, the image color in the other image formation section 20*b* may be matched with the sensing result matched with the image color in one image formation section 20*a*.

As shown in FIG. 11, a predetermined table is referenced based on the sensing signals from the color sensors 201–204 and parameters, such as developing bias as a parameter of each image formation section, secondary transfer current, and inversion corotron current, may be set.

Figure 22:
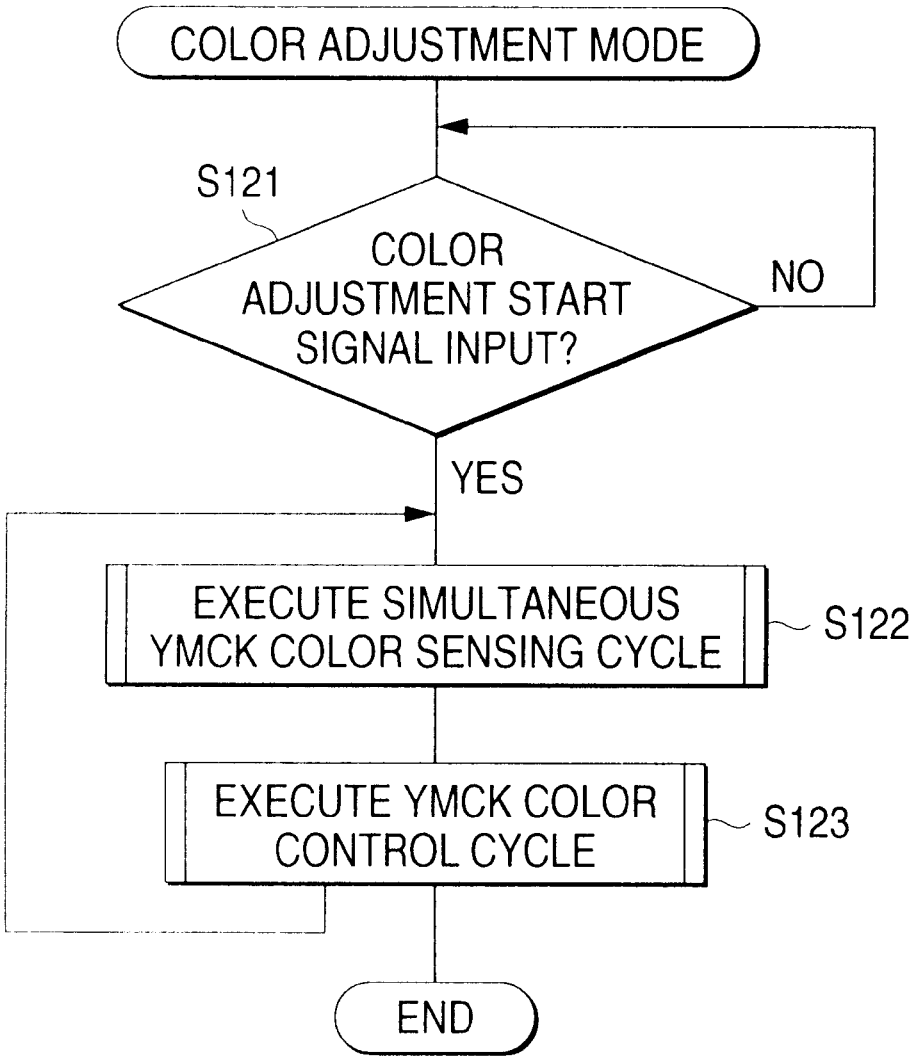
FIG. 22 is a flowchart to show another example of a color adjustment mode used in the sixth embodiment of the invention.

In the embodiment, the sensing cycle and the control cycle are executed in sequence for each color (Y, M, C, K), but the invention is not limited to it. As shown in FIG. 22, the following method may be adopted: Y, M, C, and K color patches are prepared at the same time, then the secondary transfer rolls 40*a* and 40*b* are brought into contact with each other, thereby sensing the 4-color patch densities at the same time. A predetermined table is referenced based on a total of 16 data pieces of four data pieces for each color (primary and secondary transfer densities in the first and second image formation sections 20*a* and 20*b*), DY1–DY4, DM1–DM4, DC1–DC4, and DK1–DK4, and parameters, such as developing bias as a parameter of each image formation section, secondary transfer current, and inversion corotron current, are set.

Further, the sixth embodiment may adopt a configuration similar to that in the first to fifth embodiments and may be changed in design appropriately.

Figure 23:
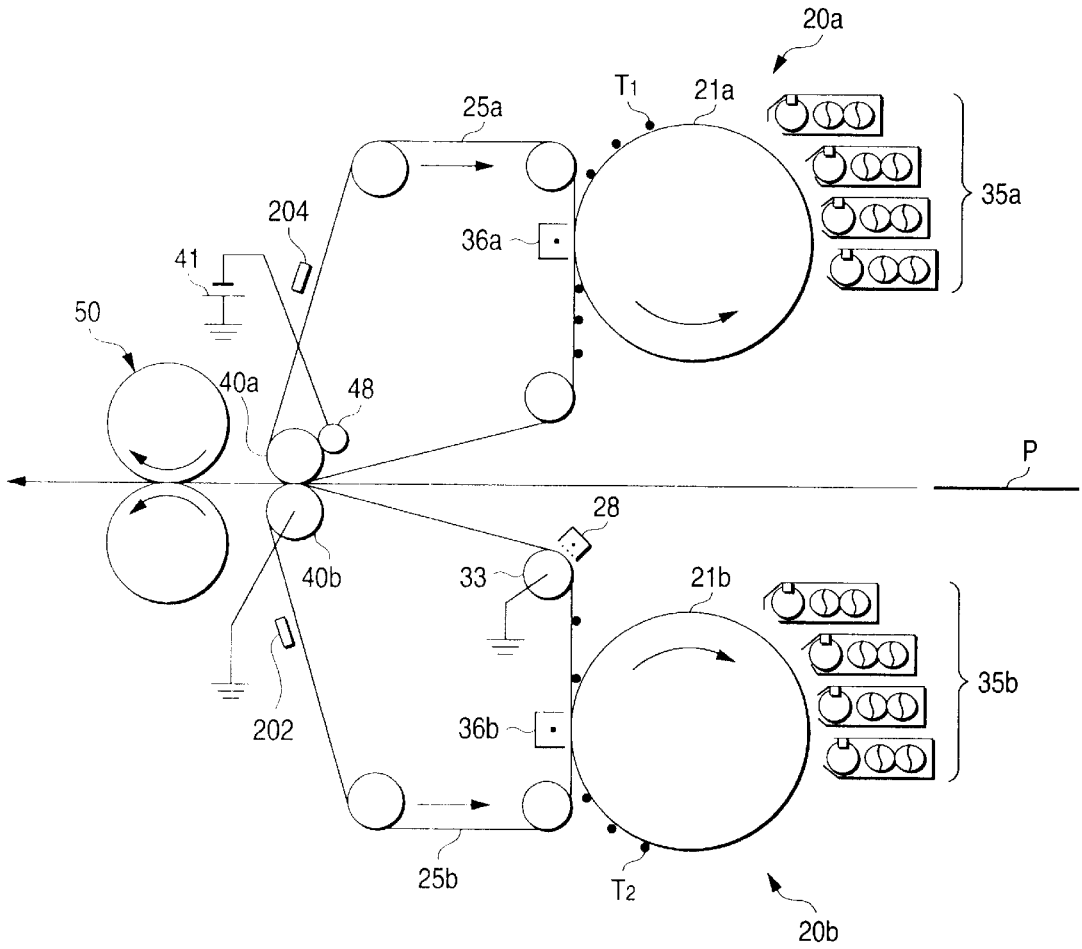
FIG. 23 is a schematic representation to show a modification of the double-sided image formation system according to the sixth embodiment of the invention.

For example, as shown in FIG. 23, the primary transfer color sensors 201 and 203 may be removed and the secondary transfer color sensors 202 and 204 may also serve as the primary transfer color sensors or first and second developing device groups 35*a* and 35*b* for developing YMCK toner images may be used in place of the rotary developing devices 34*a* and 34*b* or primary transfer corotrons 36*a* and 36*b* may be used in place of the primary transfer rolls 26*a* and 26*b* as primary transfer devices.

Figure 24:
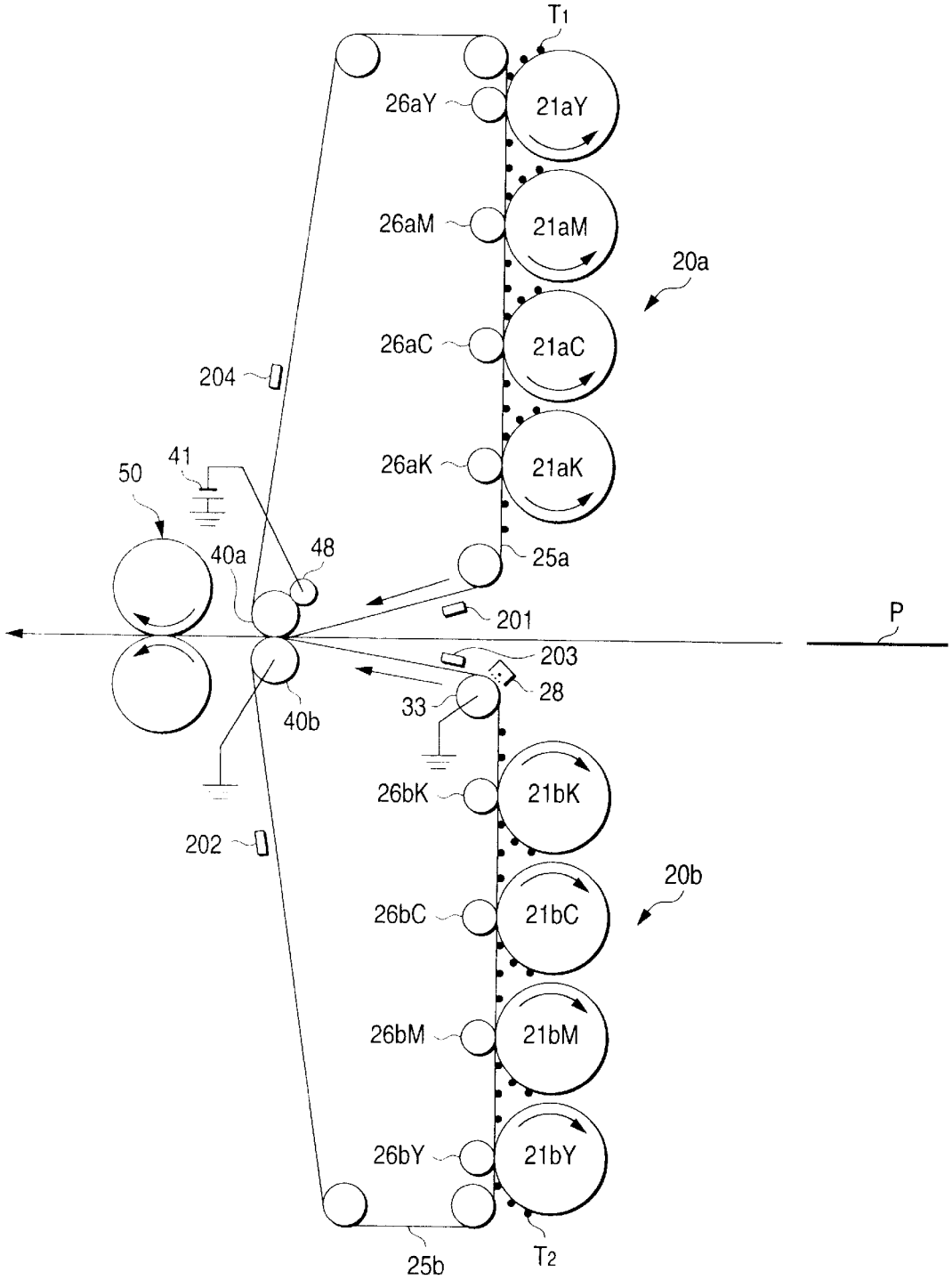
FIG. 24 is a schematic representation to show another modification of the double-sided image formation system according to the sixth embodiment of the invention.

Further, as shown in FIG. 24, the image formation section 20*a*, 20*b* may be changed in configuration so that it comprises a first photosensitive drum group 21*a* (specifically, 21*a*Y, 21*a*M, 21*a*C, and 21*a*K), a second photosensitive drum group 21*b* (specifically, 21*b*Y, 21*b*M, 21*b*C, and 21*b*K) for forming YMCK toner images, primary transfer rolls 26*a* (specifically, 26*a*Y, 26*a*M, 26*a*C, and 26*a*K), primary transfer rolls 26*b* (specifically, 26*b*Y, 26*b*M, 26*b*C, and 26*b*K) corresponding to the photosensitive drums, and an intermediate transfer belt 25*a*, 26*b*, whereby YMCK toner images T1, T2 are transferred from the photosensitive drum group 21*a* (21*a*Y–21*a*K), 21*b* (21*b*Y–21*b*K) onto the intermediate transfer belt 25*a*, 26*b* in overlapped relation.

As described above, according to the invention of aspect 1, in the double-sided image formation system which transfers the images formed in the two image formation sections to both sides of a recording medium and forms the images thereon, the image formed in one image formation section is once transferred to the image support transporter in the other image formation section before the density is sensed. Thus, the double-sided image formation system can easily keep track of the density in the state roughly corresponding to the image on the recording medium and can accurately perform density control assuming the image on the recording medium accordingly. In addition, the formation place of the image whose density is to be sensed is the image support transporter for supporting the image and moreover the remaining image can be easily cleaned, thus the density can be sensed rapidly and accurately.

Particularly, according to the invention of any of aspects 9–11, the double-sided image formation system comprising the two image formation sections of intermediate transfer type comprises the density sensing means for primary transfer in addition to the density sensing means for secondary transfer or uses the density sensing means for secondary transfer also as the density sensing means for primary transfer, thereby sensing the densities of secondarily and primarily transferred images. Thus, developing condition control and comparison between the image densities before and after secondary transfer can be performed easily and the density of the secondarily transferred image can be controlled more accurately accordingly.

According to the invention of aspect 2, the densities of the images formed on both sides of the recording medium from the two image formation sections are matched with each other, thus the density difference between the images on both sides of the recording medium can be eliminated; good images formed on both sides with no image quality difference can be provided.

Further, according to the invention of aspect 12, in the double-sided image formation system which transfers the images formed in the two image formation sections to both sides of a recording medium and forms the images thereon, the image formed in one image formation section is once transferred to the image support transporter in the other image formation section before the color is sensed. Thus, the double-sided image formation system can easily keep track of the color in the state roughly corresponding to the image on the recording medium and can accurately perform color control assuming the image on the recording medium accordingly. In addition, the formation place of the image whose color is to be sensed is the image support transporter for supporting the image and moreover the remaining image can be easily cleaned, thus the color can be sensed rapidly and accurately.

Particularly, according to the invention of any of aspects 20–22, the double-sided image formation system comprising the two image formation sections of intermediate transfer type comprises the color sensing means for primary transfer in addition to the color sensing means for secondary transfer or uses the color sensing means for secondary transfer also as the color sensing means for primary transfer, thereby sensing the colors of secondarily and primarily transferred images. Thus, developing condition control and comparison between the image colors before and after secondary transfer can be performed easily and the color of the secondarily transferred image can be controlled more accurately accordingly.

According to the invention of aspect 13, the colors of the color images formed on both sides of the recording medium from the two image formation sections are matched with each other, thus the color difference between the images on both sides of the recording medium can be eliminated; good color images formed on both sides with no image quality difference can be provided.

What is claimed is:

1. A double-sided image formation system, comprising:

two image formation sections, each image formation section having an image support transporter wherein images are supported and transported on each said image support transporter, to transfer the images on each said image support transporter to both sides of a recording medium and forming the images thereon; and density sensing means for sensing a density of said image, during which said image is being transferred from one of said two image formation sections to said image support transporter in another image formation section of said two image formation sections;

each said image support transporter faces each other in said two image formation sections, each image support transporter comprising, an image formation support for forming and supporting each image formed thereon, and an intermediate transfer body facing said image formation support where said image formed on said image formation support is temporarily transferred to said intermediate transfer body;

density sensing means for secondary transfer for sensing a density of an image transferred from said intermediate transfer body in said one image formation section to said intermediate transfer body in said another image formation section; and density sensing means for primary transfer for sensing a density of a primarily transferred image on each said intermediate transfer body.

2. The double-sided image formation system of claim 1, wherein said two image formation sections are a pair of image support transporters for supporting and transporting images, said two image formation sections facing each other.

3. The double-sided image formation system of claim 1, wherein means for sensing different information is also used as said density sensing means.

4. The double-sided image formation system of claim 1, wherein said density sensing means for secondary transfer is installed downstream from a secondary transfer position of said each image formation section, and said density sensing means for primary transfer is installed downstream from a primary transfer position of said each image formation section.

5. The double-sided image formation system of claim 1, each said image support transporter faces each other in said two image formation sections, wherein each image support transporter comprises, an image formation support for forming and supporting each image formed thereon, and an intermediate transfer body facing said image formation support where said image formed on said image formation support is temporarily transferred to said intermediate transfer body; and density sensing means for secondary transfer for sensing a density of an image transferred from said intermediate transfer body in said one image formation section to said intermediate transfer body in said another image formation section, said density sensing means also sensing a density of a primarily transferred image on each intermediate transfer body.

6. The double-sided image formation system of claim 1, wherein each image support transporter is combined to form a separate image support transporter wherein said one image formation section of said two image formation sections and said another image formation section of said two image formation sections share said separate support transporter, said separate image support transporter faces both of said two image formation sections.

7. A double-sided image formation system, comprising:

two image formation sections for forming images on both sides of a recording medium; and density adjustment means for matching an image density in one image formation section of said two image formation sections with an image density in another image formation section of said two image formation sections;

wherein said density adjustment means matches an image density on one side of the recording medium with an image on another side of the recording medium based on a same reference.

8. The double-sided image formation system of claim 7, wherein said density adjustment means sends a sensing result of the image density in one image formation section to another image formation section for matching an image density on one side of the recording medium with that on another side of the recording medium.

9. A double-sided image formation system, comprising:

two image formation sections, each image formation section having an image support transporter wherein images are supported and transported on each said image support transporter, to transfer the images on each said image support transporter to both sides of a recording medium and forming the images thereon; and density adjustment means for matching an image density in one image formation section with an image density in another image formation section, wherein each image support transporter is combined to form a separate image support transporter wherein said one image formation section of said two image formation sections and another image formation section of said two image formation sections share said separate support transporter, said separate image support transporter faces both of said two image formation sections.

10. The double-sided image formation system of claim 9, wherein said two image formation sections are a pair of image support transporters for supporting and transporting images, said two image formation sections facing each other.

11. A double-sided image formation system, comprising:

two image formation sections, each image formation section having an image support transporter wherein color images are supported and transported on each said image support transporter to both sides of a recording medium forming the color images thereon; and color sensing means that senses the image color in one image formation section of said two image formation sections, and also senses color of the color image after said color image is transferred from said one image formation section to said image support transporter in another image formation section of said image formation sections, wherein each image support transporter is combined to form a separate image support transporter wherein said one image formation section of said two image formation sections and said another image formation section of said two image formation sections share said separate support transporter, said separate image support transporter faces both of said two image formation sections.

12. The double-sided image formation system of claim 11, wherein said two image formation sections are a pair of image support transporters for supporting and transporting color images, said two image formation sections facing each other.

13. The double-sided image formation system of claim 11, wherein means for sensing different information is also used as said color sensing means.

14. The double-sided image formation system of claim 11, each said image support transporter faces each other in said two image formation sections;

each image support transporter comprising, an image formation support for forming and supporting each image formed thereon, and an intermediate transfer body facing the image formation support where said color image formed on said image formation support is temporarily transferred to said intermediate transfer body;

color sensing means for secondary transfer for sensing a color of an image transferred from said intermediate transfer body in said one image formation section to said intermediate transfer body in said another image formation section; and color sensing means for primary transfer for sensing a color of a primarily transferred image on each said intermediate transfer body.

15. The double-sided image formation system of claim 14, wherein said color sensing means for secondary transfer is installed downstream from a secondary transfer position of each said image formation section, and said color sensing means for primary transfer is installed downstream from a primary transfer position of said each image formation section.

16. The double-sided image formation system of claim 11, each said image support transporter faces each other in said two image formation sections, wherein each image support transporter comprises, an image formation support for forming and supporting each color image formed, and an intermediate transfer body facing the image formation support where said color image formed on the image formation support is temporarily transferred to said intermediate transfer body; and color sensing means for secondary transfer for sensing a color of an image transferred from said intermediate transfer body in said one image formation section to said intermediate transfer body in said another image formation section, said color sensing means also for sensing a color of a primarily transferred image on each intermediate transfer body.

17. A double-sided image formation system, comprising:

two image formation sections for forming color images on both sides of a recording medium; and color adjustment means for matching image color in one image formation section of said two image formation sections with that in another image formation section of said two image formation sections, wherein said color adjustment means matches the image color on one side of the recording medium with the image color on another side of the recording medium based on a same reference.

18. The double-sided image formation system of claim 17, wherein said color adjustment means sends a sensing result of the image color in said one image formation section to said another image formation section for matching the image color on one side of the recording medium with that on another side of the recording medium.

19. A double-sided image formation system, comprising:

two image formation sections, each image formation section having an image support transporter wherein color images are supported and transported on each said image support transporter, to transfer the color images on each said image support transporter to both sides of a recording medium and forming the color images thereon; and color adjustment means for matching image color in one image formation section of said two image formation sections with that in another image formation section of said two image formation sections, wherein each image support transporter is combined to form a separate image support transporter wherein said one image formation section of said two image formation sections and said another image formation section of said two image formation sections share said separate support transporter, said separate image support transporter faces both of said two image formation sections.

20. The double-sided image formation system of claim 19, wherein said two image formation sections are a pair of image support transporters for supporting and transporting color images, said two image formation sections facing each other.

* * * * *